US007728706B2

(12) United States Patent
Ogden, Jr. et al.

(10) Patent No.: US 7,728,706 B2
(45) Date of Patent: Jun. 1, 2010

(54) MATERIAL MAGNETIZER SYSTEMS

(76) Inventors: Orval D. Ogden, Jr., 801 Masonic Park Rd., Marietta, OH (US) 45750; Donald G. Stotler, 801 Masonic Park Rd., Marietta, OH (US) 45750; Bernard F. Ball, Sr., 801 Masonic Park Rd., Marietta, OH (US) 45750

( * ) Notice: Subject to any disclaimer, the term of this patent is extended or adjusted under 35 U.S.C. 154(b) by 247 days.

(21) Appl. No.: 12/048,140

(22) Filed: Mar. 13, 2008

(65) Prior Publication Data

US 2008/0224806 A1 Sep. 18, 2008

Related U.S. Application Data

(60) Provisional application No. 60/895,341, filed on Mar. 16, 2007, provisional application No. 60/944,077, filed on Jun. 14, 2007.

(51) Int. Cl.
*H01F 13/00* (2006.01)

(52) U.S. Cl. ..... 335/284; 335/205; 335/302

(58) Field of Classification Search ..... 335/205–207, 335/284–286; 434/81; 140/600; 428/900
See application file for complete search history.

(56) References Cited

U.S. PATENT DOCUMENTS

| | | | | |
|---|---|---|---|---|
| 4,684,930 | A * | 8/1987 | Minasy et al. | 340/551 |
| 5,428,332 | A * | 6/1995 | Srail et al. | 335/302 |
| 5,942,961 | A * | 8/1999 | Srail et al. | 335/284 |
| 6,369,679 | B1 * | 4/2002 | Cloutier et al. | 335/284 |
| 6,776,409 | B2 | 8/2004 | Cook | |
| 6,853,280 | B2 | 2/2005 | Sugawara et al. | |
| 6,881,450 | B1 | 4/2005 | Texier | |
| 7,001,645 | B1 | 2/2006 | Texier | |

FOREIGN PATENT DOCUMENTS

| | | | |
|---|---|---|---|
| EP | 1505137 | A1 | 2/2005 |
| GB | 1444858 | A | 8/1976 |
| KR | 1019830006783 | A | 10/1983 |
| WO | 9317079 | A1 | 9/1993 |

* cited by examiner

*Primary Examiner*—Lincoln Donovan
*Assistant Examiner*—Bernard Rojas
(74) *Attorney, Agent, or Firm*—Stoneman Volk Patent Group; Martin L. Stoneman; Michael D. Volk, Jr.

(57) ABSTRACT

A system for improved magnetization of flexible magnetic sheet material, such as magnetic rubber. More particularly, this invention relates to providing a system for magnetization of pre-printed flexible magnetic sheet material.

44 Claims, 21 Drawing Sheets

350
354
356
360
352
358
362
318

300
328
380
336
316
364
370
320
378
362
314
318

33
324
326
376
374
372
364
362
300
370

342
340
382
384
346

MATERIAL MAGNETIZER SYSTEMS

CROSS-REFERENCE TO RELATED APPLICATIONS

The present application is related to and claims priority from prior provisional application Ser. No. 60/895,341, filed Mar. 16, 2007, entitled "MATERIAL MAGNETIZER SYSTEMS", and is related to and claims priority from prior provisional application Ser. No. 60/944,077, filed Jun. 14, 2007, entitled "MATERIAL MAGNETIZER SYSTEMS" the contents of both of which are incorporated herein by this reference and are not admitted to be prior art with respect to the present invention by the mention in this cross-reference section.

BACKGROUND

This invention relates to providing a system for improved magnetization of flexible sheet material, such as magnetic rubber. More particularly, this invention relates to providing a system for magnetization of pre-printed flexible magnetic sheet material.

Flexible magnetic sheet material is customarily used in a variety of useful products ranging from refrigerator magnets to temporary signage applied to exterior metallic surfaces of transportation vehicles. In many applications, one surface of the flexible magnetic sheet material is imprinted with advertising or informational indicia. Most commercial printing processes prohibit the use of magnetize substrates due to interference of the printing process by the magnetic field of the sheet. It is therefore customary to magnetize the flexible magnetic sheet after printing has been applied.

The flexible magnetic sheet material customarily used in producing the above-described products has been relatively thick (often about 30 mil). This thickness has allowed the material to be magnetized to a usable degree by exposure of the unprinted side of the flexible magnetic sheet material to a magnetic field. The use of thinner more cost-effective sheet materials (thicknesses below about 15 mil), has been limited by the lack of effective post-printing magnetization processes. A system allowing a thinner (pre-printed) flexible magnetic sheet material to be magnetized to levels nearing those of conventional flexible magnetic sheet materials would be of great benefit to many.

OBJECTS AND FEATURES OF THE INVENTION

A primary object and feature of the present invention is to provide a system to overcome the above-described problems.

It is a further object and feature of the present invention to provide such a system capable of producing useful levels of magnetic imprintation within thinner (pre-printed) flexible magnetic sheet materials.

It is another object and feature of the present invention to provide such a system capable of producing sufficient magnetic force levels within pre-printed flexible magnetic sheet materials without physically contacting the pre-printed surface.

It is another object and feature of the present invention to provide such a system related to the retrofitting of at least one friction-type sheet-handling device to enable magnetization of at least one substantially planar sheet of substantially flexible magnetizable material, during movement of such at least one substantially planar sheet of substantially flexible magnetizable material along at least one transport path of the at least one friction-type sheet-handling device.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system related to magnetization of at least one substantially planar sheet of substantially flexible magnetizable material having at least one pre-printed face surface, and at least one opposite face surface, such system comprising: at least one first magnetic field source structured and arranged to produce at least one first magnetic field; at least one second magnetic field source structured and arranged to produce at least one second magnetic field; and at least one geometric positioner structured and arranged to geometrically position such at least one first magnetic field source and such at least one second magnetic field source to generate at least one first high-flux field region resulting from at least one magnetic-field interaction between such at least one first magnetic field and such at least one second magnetic field; wherein such at least one first high-flux field region is situate substantially between such at least one first magnetic field source and such at least one second magnetic field source; wherein such at least one geometric positioner comprises at least one passage structured and arranged to allow moving passage of the substantially flexible magnetizable material through such at least one first high-flux field region; wherein such at least one second magnetic field source is structured and arranged to physically contact at least one opposite face surface during passage of the at least one substantially planar sheet of substantially flexible magnetizable material through such at least one first high-flux field region; and wherein such at least one first magnetic field source is structured and arranged to avoid physical contact with the at least one pre-printed face surface during passage of the at least one substantially planar sheet of substantially flexible magnetizable material through such at least one first high-flux field region.

Moreover, it provides such a system wherein: such at least one second magnetic field source comprises at least one advancer structured and arranged to movably advance the at least one substantially planar sheet of substantially flexible magnetizable material in at least one sheet-feed direction passing substantially through such at least one first high-flux field region; and such moving advancement of the such at least one second magnetic field source substantially through such at least one first high-flux field region results in substantially permanent magnetization of at least one first region of the substantially flexible magnetizable material. Additionally, it provides such a system wherein such at least one geometric positioner comprises: at least one upper support frame structured and arranged to support such at least one first magnetic field source; and at least one lower support frame structured and arranged to rotationally support such at least one second magnetic field source.

Also, it provides such a system wherein such at least one first magnetic field source and such at least one second magnetic field source are each generated by at least one permanent magnet. In addition, it provides such a system wherein: such at least one first magnetic field source comprises at least one first magnetizer bar comprising at least one first longitudinal axis; such at least one first magnetizer bar comprises a first set of discrete field-producing laminations spaced substantially along such at least one first longitudinal axis; each discrete field-producing lamination of such first set comprises at least one substantially circular magnetic disk magnetically coupled with at least one substantially circular flux-conducting spacer; and each such at least one substantially circular magnetic disk and each such at least one substantially circular flux-conducting spacer are substantially coaxial with such at least one first longitudinal axis. And, it provides such a system wherein: such at least one second magnetic field source comprises at least one second magnetizer bar comprising at least one second longitudinal axis; such at least one second magnetizer bar comprises a second set of discrete field-producing laminations spaced substantially along such at least one second longitudinal axis; each discrete field-producing lamination of such second set comprises at least one substantially circular magnetic disk magnetically coupled with at least one substantially circular flux-conducting spacer; and each such at least one substantially circular magnetic disk and each such at least one substantially circular flux-conducting spacer are substantially coaxial with such at least one second longitudinal axis.

Further, it provides such a system further comprising: at least one powered rotator structured and arranged to rotate such at least one second magnetizer bar about such at least one second longitudinal axis; wherein rotation of such at least one second magnetizer bar by such at least one powered rotator movably advances the at least one substantially planar sheet of substantially flexible magnetizable material through such at least one first high-flux field region by frictional contact with the at least one opposite face surface; and wherein the at least one substantially planar sheet of substantially flexible magnetizable material is permanently magnetized by such movement through such at least one first high-flux field region. Even further, it provides such a system wherein such at least one upper support frame and such at least one lower support frame are structured and arranged to maintain such at least one first longitudinal axis and such at least one second longitudinal axis in substantially parallel alignment. Moreover, it provides such a system wherein such at least one upper support frame and such at least one lower support frame are structured and arranged to maintain such at least one first longitudinal axis and such at least one second longitudinal axis in substantially vertical alignment.

Additionally, it provides such a system wherein: such at least one upper support frame comprises at least one mount structured and arranged to removably mount such at least one upper support frame to such at least one lower support frame; such at least one mount is structured and arranged to maintain such at least one upper support in a fixed position relative to such at least one lower support frame; and such at least one upper support frame is structured and arranged to provide at least one freedom of movement of such at least one first magnetizer bar relative to such at least one second longitudinal axis. Also, it provides such a system further comprising: at least one third magnetic field source structured and arranged to produce at least one third magnetic field; and at least one fourth magnetic field source structured and arranged to produce at least one fourth magnetic field; wherein such at least one upper support frame is structured and arranged to support such at least one third magnetic field source; wherein such at least one lower support frame structured and arranged to rotationally support such at least one fourth magnetic field source; wherein such at least one upper support frame and such at least one lower support frame are structured and arranged to geometrically position such at least one third magnetic field source and such at least one fourth magnetic field source to generate at least one second high-flux field region resulting from at least one magnetic-field interaction between such at least one third magnetic field and such at least one fourth magnetic field; wherein such at least one second high-flux field region is situate substantially between such at least one third magnetic field source and such at least one forth magnetic field source; wherein such at least one passage is structured and arranged to allow moving passage of the substantially flexible magnetizable material through such at least one second high-flux field region; wherein such at least one fourth magnetic field source is structured and arranged to come into physical contact with the at least one opposite face surface during passage of the at least one substantially planar sheet of substantially flexible magnetizable material through such at least one second high-flux field region; and wherein such at least one third magnetic field source is structured and arranged to avoid physical contact with the at least one pre-printed face surface during passage of the at least one substantially planar sheet of substantially flexible magnetizable material through such at least one second high-flux field region. In addition, it provides such a system wherein such at least one third magnetic field source and such at least one fourth magnetic field source are each generated by at least one permanent magnet.

And, it provides such a system wherein: such at least one third magnetic field source comprises at least one third magnetizer bar comprising at least one third longitudinal axis; such at least one third magnetizer bar comprises a third set of discrete field-producing laminations spaced substantially along such at least one third longitudinal axis; each discrete field-producing lamination of such third set comprises at least one substantially circular magnetic disk magnetically coupled with at least one substantially circular flux-conducting spacer; and each such at least one substantially circular magnetic disk and each such at least one substantially circular flux-conducting spacer is substantially coaxial with such at least one third longitudinal axis. Further, it provides such a system wherein: such at least one fourth magnetic field source comprises at least one fourth magnetizer bar comprising at least one fourth longitudinal axis; such at least one fourth magnetizer bar comprises a fourth set of discrete field-producing laminations spaced substantially along such at least one fourth longitudinal axis; each discrete field-producing lamination of such fourth set comprises at least one substantially circular magnetic disk magnetically coupled with at least one substantially circular flux-conducting spacer; and each such at least one substantially circular magnetic disk and each such at least one substantially circular flux-conducting spacer is substantially coaxial with such at least one forth longitudinal axis.

Even further, it provides such a system wherein: such at least one powered rotator is structured and arranged to provide powered rotation of such at least one fourth magnetizer bar about such at least one fourth longitudinal axis; such powered rotation of such at least one fourth magnetizer bar movably advances the at least one substantially planar sheet of substantially flexible magnetizable material through such at least one second high-flux field region by frictional contact with the at least one opposite face surface; and at least one second region of the at least one substantially planar sheet of substantially flexible magnetizable material is permanently magnetized by such movement through such at least one second high-flux field region. Moreover, it provides such a system wherein: such at least one upper support frame and such at least one lower support frame are structured and arranged to maintain such at least one first longitudinal axis, such at least one second longitudinal axis, such at least one third longitudinal axis, and such at least one fourth longitudinal axis in substantially parallel alignment; and such at least one upper support frame and such at least one lower support frame are structured and arranged to maintain such at least one third longitudinal axis and such at least one fourth longitudinal axis in substantially vertical alignment.

Additionally, it provides such a system wherein: such first set of discrete field-producing laminations of such at least one first magnetizer bar are axially offset from such third set of discrete field-producing laminations of such at least one third magnetizer bar; and such second set of discrete field-producing laminations of such at least one second magnetizer bar are axially offset from such fourth set of discrete field-producing laminations of such at least one fourth magnetizer bar. Also, it provides such a system wherein: such first set of discrete field-producing laminations of such at least one first magnetizer bar are vertically aligned with such second set of discrete field-producing laminations of such at least one second magnetizer bar; and such first set of discrete field-producing laminations and such second set of discrete field-producing laminations comprise opposite opposing polar moments. In addition, it provides such a system wherein such third set of discrete field-producing laminations of such at least one third magnetizer bar are vertically aligned with such fourth set of discrete field-producing laminations of such at least one fourth magnetizer bar. And, it provides such a system further comprising at least one rotation-rate coordinator structured and arranged to coordinate the rotation rates of such at least one second magnetizer bar and such at least one fourth magnetizer bar. Further, it provides such a system wherein such at least one rotation-rate coordinator comprises at least one arrangement of intermeshed toothed gears.

Even further, it provides such a system wherein such at least one powered rotator comprises: at least one electrically driven motor comprising at least one output shaft structured and arranged to transmit at least one torque force produced by such at least one electrically driven motor; coupled to such at least one output shaft, at least one first resilient roller rotationally supported within such at least one lower support frame; at least one second resilient roller rotationally supported within such at least one lower support frame; and at least one third resilient roller rotationally supported within such at least one lower support frame; wherein such at least one first resilient roller, such at least one second resilient roller, and such at least one third resilient roller are rotationally coupled by such at least one arrangement of intermeshed toothed gears; wherein such at least one first resilient roller and such at least one second resilient roller are structured and arranged rotate such at least one second magnetizer bar by frictional contact; wherein such at least one second resilient roller and such at least one third resilient roller are structured and arranged to rotate such at least one fourth magnetizer bar by frictional contact; and wherein rotation of such at least one first resilient roller induces rotation in such at least one second resilient roller, such at least one third resilient roller, such at least one second magnetizer bar, and such at least one fourth magnetizer bar.

In accordance with another preferred embodiment hereof, this invention provides a method related to magnetization of at least one sheet of substantially flexible magnetizable material having at least one first planar face and at least one second planar face, such method comprising the steps of: providing at least one first magnet structured and arranged to produce at least one first magnetic field; providing at least one second magnet structured and arranged to produce at least one second magnetic field; producing at least one high-flux field region by geometrically positioning such at least one first magnet above such at least one second magnet to produce at least one high-flux gap therebetween; forming at least one frictional surface contact between such at least one second magnet and the at least one second planar face; manipulating such at least one second magnet to movably advance the at least one sheet of substantially flexible magnetizable material through such at least one high-flux gap; and at least partially magnetizing the at least one sheet of substantially flexible magnetizable material during such advancement through such at least one high-flux gap.

Moreover, it provides such a method wherein the step of manipulating such at least one second magnet to movably advance the at least one sheet of substantially flexible magnetizable material through such at least one high-flux gap comprises the step of rotating such at least one second magnet to facilitate such advancement.

In accordance with another preferred embodiment hereof, this invention provides a method related to hand-held magnetization of at least one sheet of substantially flexible magnetizable material comprising at least one substantially planar surface, such method comprising the steps of: providing at least one modular end cap structured and arranged to rotationally engage at least one first end of at least one cylindrical magnet bar; selecting from a set of hand-holdable bodies comprising differing fixed lengths, at least one fixed-length hand-holdable body structured and arranged to rotationally engage at least one second end of the at least one cylindrical magnet bar; selecting from a set of cylindrical magnet bars comprising differing fixed lengths, at least one cylindrical magnet bar comprising a fixed length compatible with such at least one fixed-length hand-holdable body; engaging such at least one second end of such at least one cylindrical magnet bar within such at least one fixed-length hand-holdable body; engaging such at least one first end of such at least one cylindrical magnet bar within such modular end cap; and mounting such modular end cap to such at least one fixed-length hand-holdable body.

Additionally, it provides such a method further comprising the steps of: hand gripping such at least one fixed-length hand-holdable body; positioning such at least one cylindrical magnet bar to contact the at least one substantially planar surface; and rolling such at least one cylindrical magnet bar across the at least one substantially planar surface to at least partially magnetize the at least one substantially planar sheet of substantially flexible magnetizable material.

In accordance with another preferred embodiment hereof, this invention provides a system related to the retrofitting of at least one friction-type sheet-handling device to enable magnetization of at least one substantially planar sheet of substantially flexible magnetizable material, during movement of such at least one substantially planar sheet of substantially flexible magnetizable material along at least one transport path of the at least one friction-type sheet-handling device, such system comprising: at least one magnetic field source structured and arranged to generated at least one magnetic field usable to magnetize the at least one substantially planar sheet of substantially flexible magnetizable material; and at least one mount structured and arranged to mount such at least one magnetic field source to the at least one friction-type sheet-handling device; wherein such at least one mount comprises at least one positioner structured and arranged to situate such at least one magnetic field source in at least one position producing at least one magnetic-field interaction between such at least one substantially planar sheet of substantially flexible magnetizable material and the magnetic field as such at least one substantially planar sheet of substantially flexible magnetizable material moves along the at least one transport path; and wherein such at least one substantially planar sheet of substantially flexible magnetizable material is permanently magnetized by such at least one magnetic-field interaction. Also, it provides such a system wherein such at least one magnetic field source comprises at least one field-producing roller structured and arranged to produce the magnetic field; wherein such at least one field-producing roller is rotatably held by such at least one mount. In addition, it provides such a system wherein such at least one magnetic field source further comprises: at least one field-conducting roller structured and arranged to form at least one magnetic circuit with such at least one magnetic roller; and situate between such at least one field-producing roller and such at least one field-conducting roller, at least one air gap structured and arranged to enable passage of such at least one substantially planar sheet of substantially flexible magnetizable material, therethrough; wherein such at least one field-conducting roller is rotatably held by such at least one mount. And, it provides such a system wherein: such at least one field-producing roller comprises at least one first rotator structured and arranged to rotate such at least one field-producing roller, in at least one first direction, about at least one first rotational axis oriented substantially perpendicular to the movement of such at least one substantially planar sheet of substantially flexible magnetizable material, during passage of such at least one substantially planar sheet of substantially flexible magnetizable material through such at least one air gap; such at least one field-conducting roller comprises at least one second rotator structured and arranged to rotate such at least one field-producing roller, in at least one second direction, about at least one second rotational axis oriented substantially perpendicular to the movement of such at least one substantially planar sheet of substantially flexible magnetizable material, during passage of such at least one substantially planar sheet of substantially flexible magnetizable material through such at least one air gap; such at least one air gap is sized to provide substantially contemporaneous frictional contact between such at least one substantially planar sheet of substantially flexible magnetizable material and both such at least one field-producing roller and such at least one field-conducting roller during passage therethrough; and such rotation of such at least one field-producing roller and such at least one field-conducting roller movably advance the at least one substantially planar sheet of substantially flexible magnetizable material through such at least one air gap. Further, it provides such a system wherein such at least one first rotator comprises at least one first torque transfer member structured and arranged to transfer at least one first torque force of at least one first rotating member of the at least one friction-type sheet-handling device to such at least one field-producing roller. Even further, it provides such a system wherein such at least one second rotator comprises at least one second torque transfer member structured and arranged to transfer at least one second torque force of at least one second rotating member of the at least one friction-type sheet-handling device to such at least one field-conducting roller. Moreover, it provides such a system wherein such at least one first torque transfer member comprises at least one substantially flexible drive belt.

Additionally, it provides such a system wherein such at least one first torque transfer member comprises at least one chain drive structured and arranged to engage at least one sprocket gear. Also, it provides such a system wherein such at least one second torque transfer member comprises at least one substantially flexible drive belt. In addition, it provides such a system wherein such at least one second torque transfer member comprises at least one chain drive structured and arranged to engage at least one sprocket gear. And, it provides such a system wherein such at least one magnetic field source is generated by at least one permanent magnet. Further, it provides such a system wherein: such at least one field-producing roller comprises a plurality of substantially circular magnetic disks each one magnetically coupled with at least one substantially circular flux-conducting spacer; and each such at least one substantially circular magnetic disk and each such at least one substantially circular flux-conducting spacer are substantially coaxial with such at least one first longitudinal axis. Even further, it provides such a system further comprising at least one separator member structured and arranged to separate such at least one substantially planar sheet of substantially flexible magnetizable material from such at least one field-producing roller after such permanent magnetization. Even further, it provides such a system wherein such at least one mount comprises: at least one first end plate and at least one second end plate; wherein such at least one first end plate and such at least one second end plate comprise at least one paired set of receivers, each one structured and arranged to rotatably receive a respective end of such at least one field-producing roller and such at least one field-conducting roller, and at least one mechanical fastener structured and arranged to mechanically fasten such at least one first end plate and such at least one second end plate to the at least one friction-type sheet-handling device; wherein each paired set of receiver comprises at least one friction-reducing bearing structured and arranged to assist reduced-friction rotation of such at least one field-producing roller and such at least one field-conducting roller. Even further, it provides such a system wherein such at least one field-conducting roller is situate substantially at the end of the at least one transport path of the at least one friction-type sheet-handling device.

In accordance with another preferred embodiment hereof, this invention provides a method related to the retrofitting of at least one friction-type sheet-handling device to enable magnetization of at least one substantially planar sheet of substantially flexible magnetizable material, during movement of such at least one substantially planar sheet of substantially flexible magnetizable material along at least one transport path of the at least one friction-type sheet-handling device, such method comprising the steps of: identifying at least one friction-type sheet-handling device adapted to move such at least one substantially planar sheet of substantially flexible magnetizable material along at least one transport path between at least one initial position and at least one final position; providing at least one magnetic field source structured and arranged to generated at least one magnetic field usable to magnetize the at least one substantially planar sheet of substantially flexible magnetizable material; and providing at least one mount to assist the mounting of such at least one magnetic field source to the at least one friction-type sheet-handling device, wherein such at least one mount is structured and arranged to situate such at least one magnetic field source in at least one position producing at least one magnetic-field interaction between such at least one substantially planar sheet of substantially flexible magnetizable material and the magnetic field as such at least one substantially planar sheet of substantially flexible magnetizable material moves along the at least one transport path.

Even further, it provides such a method further comprising the step of: mounting such at least one magnetic field source to the at least one friction-type sheet-handling device using such at least one mount; wherein at least one modified friction-type sheet-handling device capable of permanently magnetizing such at least one substantially planar sheet of substantially flexible magnetizable material is achieved. Even further, it provides such a method further comprising the step of permanently magnetizing such at least one substantially planar sheet of substantially flexible magnetizable material using such at least one modified friction-type sheet-handling device.

DETAILED DESCRIPTION OF THE BEST MODES AND PREFERRED EMBODIMENTS OF THE INVENTION

Figure 1:
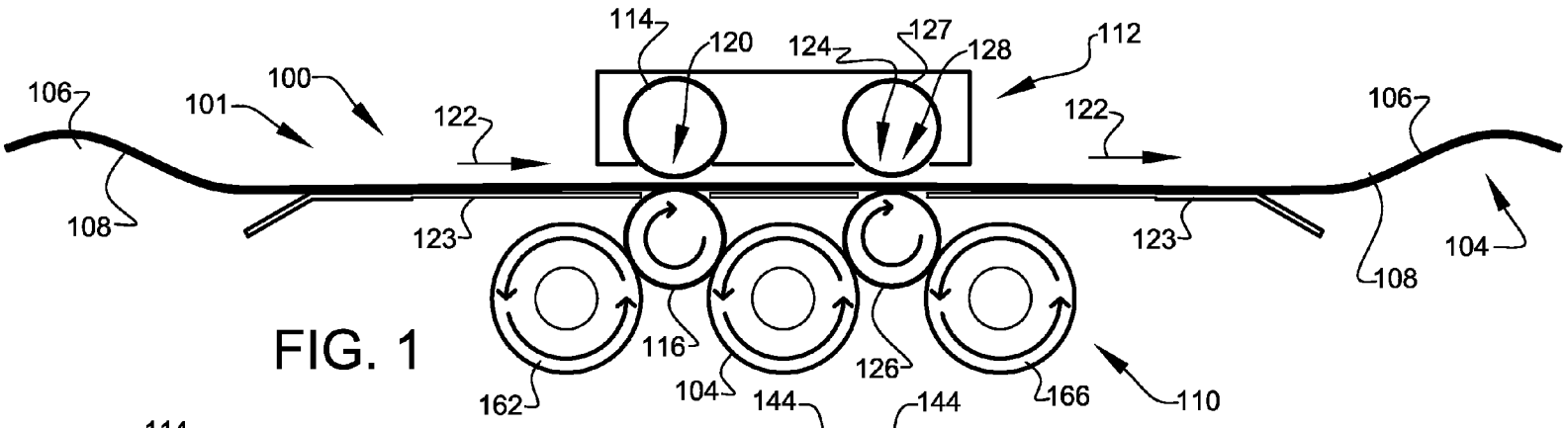
FIG. 1 shows a generalized schematic side view illustrating the principal operational components of a high-energy sheet magnetizer according to preferred embodiments of the present invention.
Figure 2:
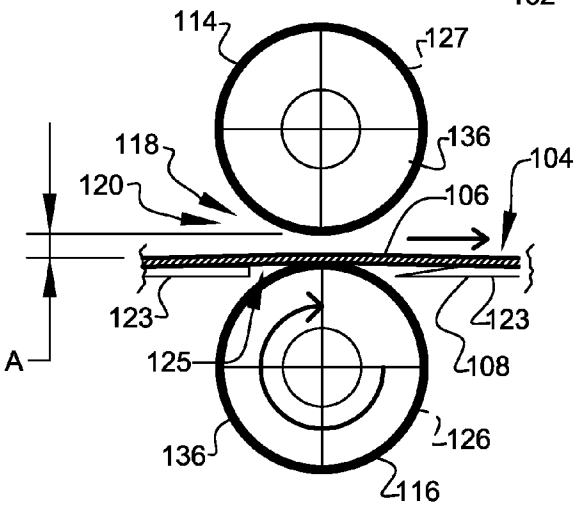
FIG. 2 shows a schematic detail view illustrating the principal operational components of the high-energy sheet magnetizer according to preferred embodiments of the present invention.

FIG. 1 shows a generalized schematic side view illustrating the principal operational components of a generalized high-energy sheet magnetizer 101. FIG. 2 shows a schematic detail view illustrating the principal operational components of high-energy sheet magnetizer 101 according to preferred embodiments of the present invention.

High-energy sheet magnetizer 101 is illustrative of a preferred embodiment of the magnetizer system, generally identified herein as sheet magnetizer system 100. High-energy sheet magnetizer 101 preferably functions to magnetize magnetically imprintable sheet materials such as flexible magnetic sheet 104. Preferably, flexible magnetic sheet 104 comprises a substantially planar sheet of substantially flexible magnetizable material having at least one pre-printed side 106 and at least one substantially unprinted side 108. Such flexible magnetic sheet materials generally combine a fine magnetizable material within a flexible binder. The magnetizable material typically comprises a pulverized ceramic ferrite in a thermoplastic binder. Exposure of the resulting material to a magnetic field produces a magnetic "imprint" within the compound, thus generating a substantially permanent magnet, preferably exhibiting its own measurable magnetic field.

As noted above, achieving useful flux densities in thinner flexible magnetic sheet materials is difficult due to the decreased volume of magnetic materials within the cross-section. The preferred arrangements of high-energy sheet magnetizer 101 overcome this limitation by exposing flexible magnetic sheet 104 to regions of high magnetic field intensity. This technique is particularly effective in producing thin flexible magnetic sheet materials exhibiting enhanced magnetic pull strength (approaching flux densities typically associated thicker sheets). In addition, the preferred structures and arrangements of high-energy sheet magnetizer 101 allows flexible magnetic sheet 104 to be magnetized without physical contact between structures of high-energy sheet magnetizer 101 and the surface of pre-printed side 106. This highly preferred aspect of the design greatly reduces cost associated with product loss due to damage of the printed surface during the magnetization process.

High-energy sheet magnetizer 101 preferably comprises upper magnetizer unit 112 and lower magnetizer base-assembly 110, as shown. Upper magnetizer unit 112 is preferably positioned above lower magnetizer base-assembly 110, as shown. Preferably, upper magnetizer unit 112 comprises at least one first magnetic field source preferably comprising first magnet bar 114, as shown. Preferably, lower magnetizer base-assembly 110 comprises at least one second magnetic field source preferably comprising second magnet bar 116, as shown. Preferably, upper magnetizer unit 112 and lower magnetizer base-assembly 110 are structured and arranged to geometrically position first magnet bar 114 and second magnet bar 116 to produce at least one magnetic field interaction. Preferably, first magnet bar 114 and second magnet bar 116 are geometrically positioned in a closely adjacent and substantially vertical alignment, as shown. This preferred magnetic-field interaction between the magnetic fields of first magnet bar 114 and second magnet bar 116 preferably produces at least one first high-flux field region 118, as shown. Preferably, first high-flux field region 118 is situate substantially between first magnet bar 114 and second magnet bar 116, as shown. Preferably, first high-flux field region is situate substantially within a first gap 120 formed between first magnet bar 114 and second magnet bar 116, as shown.

Preferably, flexible magnetic sheet 104 is movably advanced along a linear feed path 122, as schematically illustrated by the arrow depictions of FIG. 1. Preferably, flexible magnetic sheet 104 is exposed to first high-flux field region 118 as it passes through first gap 120 during the advancement along feed path 122, as shown (at least embodying herein wherein such at least one geometric positioner comprises at least one passage structured and arranged to allow moving passage of the substantially flexible magnetizable material through such at least one first high-flux field region). Passage of flexible magnetic sheet 104 through first high-flux field region 118 preferably produces the above-described magnetic imprinting within those portions of the sheet material exposed to first high-flux field region 118 (the exposed regions showing significant magnetic hysteresis).

Preferably, feed path 122 is structured to bring second magnet bar 116 into physical contact with unprinted side 108 during passage of flexible magnetic sheet 104 through first high-flux field region 118, as shown. Preferably, the substantially horizontal deck surface 123 of feed path 122 comprises at least one opening 125 through which second magnet bar 116 upwardly projects to contact unprinted side 108, as shown. This is in contrast to the preferred positioning of first magnet bar 114 by upper magnetizer unit 112, preferably arranged to avoid substantially all physical contact between the pre-printed side 106 of flexible magnetic sheet 104 and first magnet bar 114, as shown. Preferably, first magnet bar 114 and second magnet bar 116 are spaced at the smallest practical distance that results in consistent avoidance of physical contact between first magnetic bar 114 and pre-printed side 106 during passage of flexible magnetic sheet 104 through first high-flux field region 118. A surface-to-magnet separation A of not more than a few millimeters is generally preferred. This preferred relationship assists in maintaining high-gauss flux levels within the magnetic circuit formed across first gap 120. Upon reading the teachings of this specification, those of ordinary skill in the art will now understand that, under appropriate circumstances, considering such issues as intended use, magnitude of the flux within the magnetic circuit, composition of the sheet material, etc., other gap arrangements, such as larger or smaller gaps, active/dynamic gap adjustment assemblies, etc., may suffice.

Preferably, second magnet bar 116 is structured and arranged to movably advance flexible magnetic sheet 104, in the depicted sheet-feed direction along feed path 122, as shown. Preferably, rotation of second magnet bar 116 movably advances flexible magnetic sheet 104 through first high-flux field region 118 by frictional contact with unprinted side 108, as shown.

Preferably, second magnet bar 116 is rotationally mounted within magnetizer base-assembly 110. In addition, second magnet bar 116 is preferably operationally coupled to powered rotator assembly 130 that preferably transmits at least one rotational force (torque) to second magnet bar 116 (see FIG. 4). This preferred arrangement results in powered rotation of second magnet bar 116 and advancement of flexible magnetic sheet 104 along feed path 122, as shown. Preferably, on passage through first high flux field region 118, flexible magnetic sheet 104 is preferably exposed to at least one second high-flux field region 124, as described below.

Preferably, upper magnetizer unit 112 further comprises at least one third magnetic field source, preferably comprising third magnet bar 127, as shown. Preferably, lower magnetizer base-assembly 110 further comprises at least one fourth magnetic field source preferably comprising fourth magnet bar 126, as shown. The preferred relationship between third magnet bar 127 and fourth magnet bar 126 is substantially similar to the above description pertaining to first magnet bar 114 and second magnet bar 116. Briefly stated, the geometric relationship between third magnet bar 127 and fourth magnet bar 126 preferably produces at least one second high-flux field region 124 resulting from magnetic-field interactions between third magnet bar 127 and fourth magnet bar 126. Preferably, second high-flux field region 124 is situated substantially within second gap 128 formed between third magnet bar 127 and fourth magnet bar 126, as shown.

Preferably, flexible magnetic sheet 104 is exposed to second high-flux field region 124 during passage through second gap 128 as the sheet is advanced along feed path 122, as shown. Passage of flexible magnetic sheet 104 through second high-flux field region 124 preferably produces a magnetic imprint within portions of the sheet material (more preferably within regions of that were not exposed to first high-flux field region 118).

Preferably, feed path 122 is structured to bring fourth magnet bar 126 into physical contact with unprinted side 108 during passage of flexible magnetic sheet 104 through second high-flux field region 124, as shown. Like first magnet bar 114, upper magnetizer unit 112 preferably positions third magnet bar 127 to avoid substantially all physical contact between the pre-printed side 106 of flexible magnetic sheet 104 and third magnet bar 127. Upon reading the teachings of this specification, those of ordinary skill in the art will now understand that, under appropriate circumstances, considering such issues as intended use, durability of printing, etc., other magnetic bar positioning arrangements, such as the positioning of the upper magnetic bars to make minimal contact with a printed surface, utilizing active dynamic adjustment mechanisms to maintain ideal positional spacing, etc., may suffice.

Figure 4:
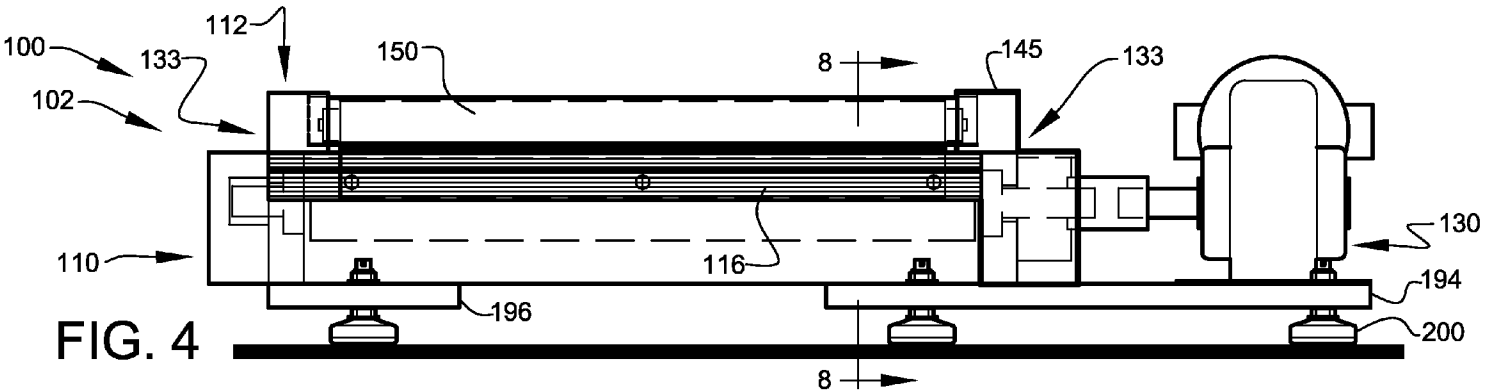
FIG. 4 shows a side view of a high-energy sheet magnetizer comprising an upper magnetizer unit mounted to a lower magnetizer base assembly according to a preferred embodiment of the present invention.

Preferably, fourth magnet bar 126 is also structured and arranged to movably advance flexible magnetic sheet 104 along feed path 122, in the depicted sheet-feed direction. Like second magnet bar 116, fourth magnet bar 126 is rotationally mounted within magnetizer base-assembly 110 and is preferably coupled to powered rotator assembly 130 (as shown in FIG. 4). This preferred arrangement results in powered rotation of fourth magnet bar 126 and power-assisted advancement of flexible magnetic sheet 104 along feed path 122, as shown.

Figure 3:
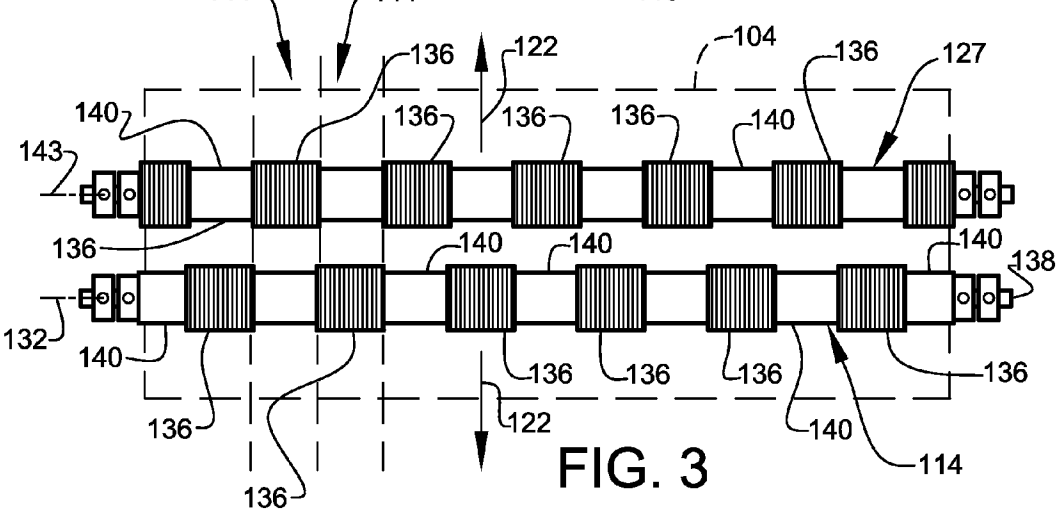
FIG. 3 shows a plan view of a pair of high-energy magnetizer bars according to preferred embodiments of the present invention.

FIG. 3 shows a plan view illustrating a preferred arrangement of magnet bars according to preferred embodiments of the present invention. The illustration of FIG. 3 is representative of the functional pairing of first magnet bar 114 and third magnet bar 127 of upper magnetizer unit 112 or second magnet bar 116 and fourth magnet bar 126 of magnetizer base-assembly 110. For clarity of description, the functional pairing of first magnet bar 114 and third magnet bar 127 will be discussed with the understanding that the teachings equally applicable to the functional pairing of second magnet bar 116 and fourth magnet bar 126. Furthermore, the magnet bars have been isolated from the overall assembly for clarity.

Preferably, both first magnet bar 114 and third magnet bar 127 extend substantially across substantially the full width of flexible magnetic sheet 104, as shown. Preferably, first magnet bar 114 comprises first longitudinal axis 132 preferably oriented substantially perpendicular to the linear axis 134 of feed path 122 (as generally defined by the direction of sheet motion), as shown. Preferably, first magnet bar 114 comprises a first set of discrete magnetizer banks 136, preferably spaced substantially along the width of first longitudinal axis 132, as shown. Preferably, each magnetizer bank 136 comprises an alternating sequence of magnetic plates and flux-conducting plates (as best described in FIG. 12 and FIG. 13). Preferably, each magnetic plate comprises a high-strength permanent magnet and each flux-conducting plate preferably comprises a material exhibiting high permeability when saturated. Preferably, both magnetic plates and flux-conducting plates comprise substantially circular peripheral shapes, as shown in FIG. 2. Preferably, each substantially circular magnetic plate and each substantially circular flux-conducting plate are substantially coaxial with first longitudinal axis 132, as shown. Thus, the sequential laminations of each magnetizer bank 136 form a substantially cylindrical peripheral surface.

Preferably, magnetizer banks 136 of first magnet bar 114 are mounted coaxially on a central bar 138, as shown. Preferably, magnetizer banks 136 are separated by a set of spacers 140 that are also preferably mounted coaxially on central bar 138, as shown. Spacers 140 preferably comprise widths generally matching those of magnetizer banks 136, as shown.

The preferred structures and arrangements of second magnet bar 116 are substantially identical to those of first magnet bar 114, as described above. Preferably, the placement of magnetizer banks 136 along second longitudinal axis 142 of second magnet bar 116 are substantially identical to those of first magnet bar 114. This preferably places the lower magnetizer banks 136 of second magnet bar 116 in vertical alignment with the upper magnetizer banks 136 of first magnet bar 114, as illustrated in FIG. 2. Thus, a plurality of first high-flux field regions 118 (six in the depicted embodiment)are preferably generated within first gap 120 by the preferred vertical stacking of first magnet bar 114 over second magnet bar 116 and the resulting formation of magnetic flux circuits between upper and lower magnet bars.

The preferred structures and arrangements of third magnet bar 127 are substantially similar to those of first magnet bar 114, with the exception of the preferred positioning of magnetizer banks 136 along third longitudinal axis 143, as shown. Note that magnetizer banks 136 of first magnet bar 114 are preferably axially offset from magnetizer banks 136 of third magnet bar 127. More preferably, magnetizer banks 136 of first magnet bar 114 are axially offset a preferred distance substantially equal to the width of one magnetizer bank 136, as shown (similarly, magnetizer banks 136 of second magnet bar 116 are axially offset from those of fourth magnet bar 126). This preferred arrangement produces a plurality of second high-flux field regions 124 (seven in the depicted embodiment) within second gap 128, each second high-flux field region 124 preferably generated by the preferred vertical stacking of third magnet bar 127 over fourth magnet bar 126. Note that the plurality of second high-flux field regions 124 of second gap 128 are preferably axially offset from the plurality of first high-flux field regions 118 of first gap 120.

The preferred axial offsetting of magnetizer banks 136 assures that the full width of flexible magnetic sheet 104 is exposed to at least one of the above-described high-flux field regions as it is advanced along feed path 122, as shown. Thus, magnetization of flexible magnetic sheet 104 preferably occurs in parallel strips 144 defined by alternating exposure to the magnetic fields of the first/second and third/fourth magnet bars, as shown. The preferred axial offsetting of the depicted embodiment has been shown to reduce feed-related problems related to the adhering and wrapping of flexible magnetic sheet 104 around the magnetizing bars during operation. Upon reading the teachings of this specification, those of ordinary skill in the art will now understand that, under appropriate circumstances, considering such issues as intended use, physical characteristics of the flexible magnetic sheet, etc., other magnet arrangements, such as utilizing a continuous array of magnets extending substantially across the sheet width, etc., may suffice.

Figure 5:
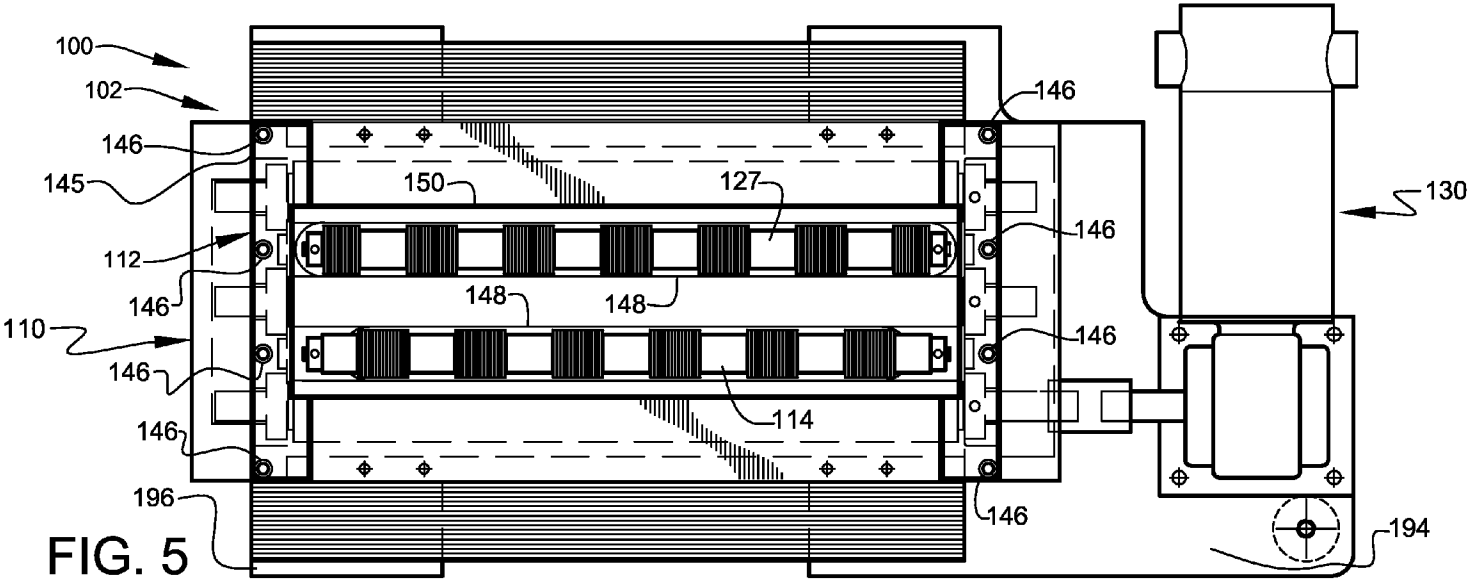
FIG. 5 shows a top view of the high-energy sheet magnetizer illustrating a preferred positioning of the upper magnetizer unit over the lower magnetizer base assembly according to the preferred embodiment of FIG. 4.

FIG. 4 shows a side view of high-energy sheet magnetizer 102 comprising upper magnetizer unit 112 mounted to lower magnetizer base assembly 110 according to a preferred embodiment of the present invention. FIG. 5 shows a top view of high-energy sheet magnetizer 102 illustrating a preferred positioning of upper magnetizer unit 112 over lower magnetizer base assembly 110 according to the preferred embodiment of FIG. 4.

Preferred commercial embodiments of high-energy sheet magnetizer 102 are produced in two widths, a 13-inch model and a 25-inch model. For illustrative purposes, the following teachings shall describe preferred structures and arrangements of the 13-inch embodiment. Those of ordinary skill in the art will appreciate, upon reading the teachings of this specification, that without undue experimentation, a number of alternate embodiment widths may be readily developed, including the previously described 25-inch model. The teachings of this specification will address specific alternate preferred arrangements of the 25-inch embodiment, as applicable.

Figure 9:
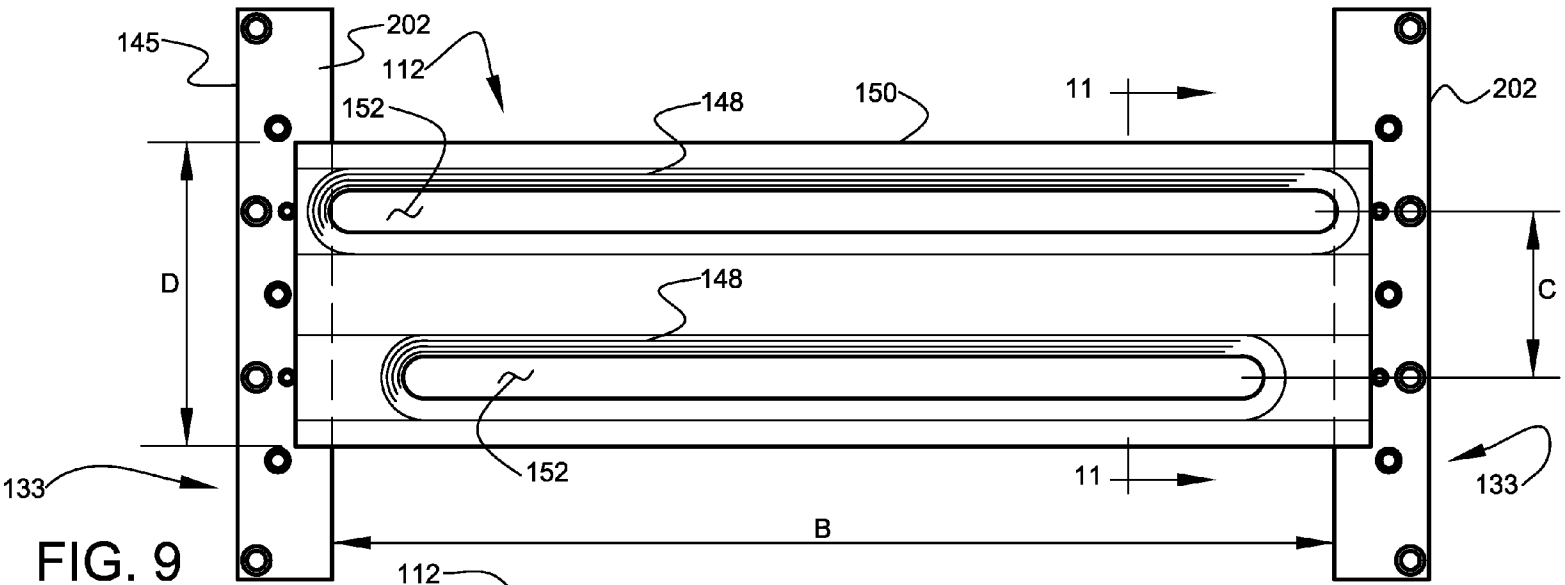
FIG. 9 shows a top view of the support frame of the upper magnetizer unit of FIG. 4.
Figure 10:
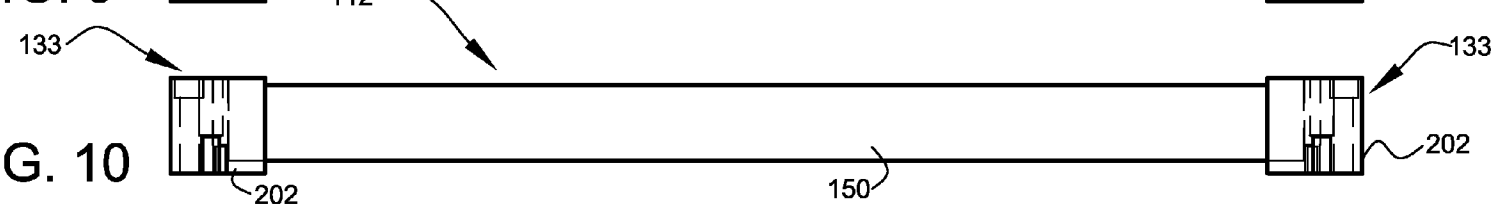
FIG. 10 shows a side view of the support frame of the upper magnetizer unit of FIG. 4
Figure 11:
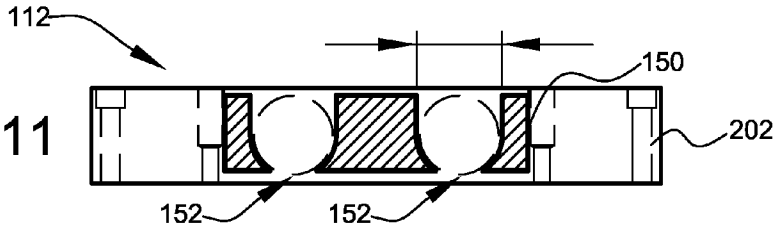
FIG. 11 is a sectional view through the section 11-11 of FIG. 9.

Preferably, upper magnetizer unit 112 comprises a rigid support frame 145 adapted to support and position both first magnet bar 114 and third magnet bar 127 during operation, as shown. Preferably, support frame 145 comprises cross support 150 modified to comprise a pair of linear receiver slots 148 (a preferred configuration of support frame 145 is best illustrated in FIG. 9, FIG. 10, and FIG. 11).

Preferably, first magnet bar 114 and third magnet bar 127 are each located in one of the linear receiver slots 148, as shown. Preferably, the lower portion of each linear receiver slot 148 comprises a linear slot aperture 152, preferably extending substantially the length of each linear receiver slot 148, as shown. Slot apertures 152 preferably allow magnetizer banks 136 to extend downwardly through support frame 145, as best shown in FIG. 10. Preferably, linear receiver slots 148 are adapted to support both first magnet bar 114 and third magnet bar 127 in substantially parallel alignment, as shown.

Preferably, both first magnet bar 114 and second magnet bar 116 are loosely supported within linear receiver slots 148, as shown. Preferably, both first magnet bar 114 and second magnet bar 116 are maintained in the preferred operable position by gravity positioning, as shown. This preferred arrangement allows both upper magnet bars to move vertically relative to the lower magnet bars (at least embodying herein wherein such at least one upper support frame is structured and arranged to provide at least one freedom of movement of such at least one first magnet bar relative to such at least one second longitudinal axis). This preferred arrangement reduces the potential for damage to pre-printed side 106 in the event of a jam or other misfeed along the path 122. Upon reading the teachings of this specification, those of ordinary skill in the art will now understand that, under appropriate circumstances, considering such issues as intended use, cost, preference, etc., other mounting arrangements, such as mounting the upper magnetic bars in fixed the bearing seats, etc., may suffice.

Preferably, mount assembly 133, removably fastens upper magnetizer unit 112 to magnetizer base-assembly 110, as shown. This preferred arrangement allows upper magnetizer unit 112 to be removed from magnetizer base-assembly 110 when high-energy magnetization is not required (at least embodying herein wherein such at least one upper support frame comprises at least one mount structured and arranged to removably mount such at least one upper support frame to such at least one lower support frame). Preferably, mount assembly 133 is structured and arranged to maintain upper magnetizer unit 112 in a fixed position relative to magnetizer base-assembly 110 using a plurality of mechanical fasteners, most preferably threaded fasteners 146, as shown.

Figure 6:
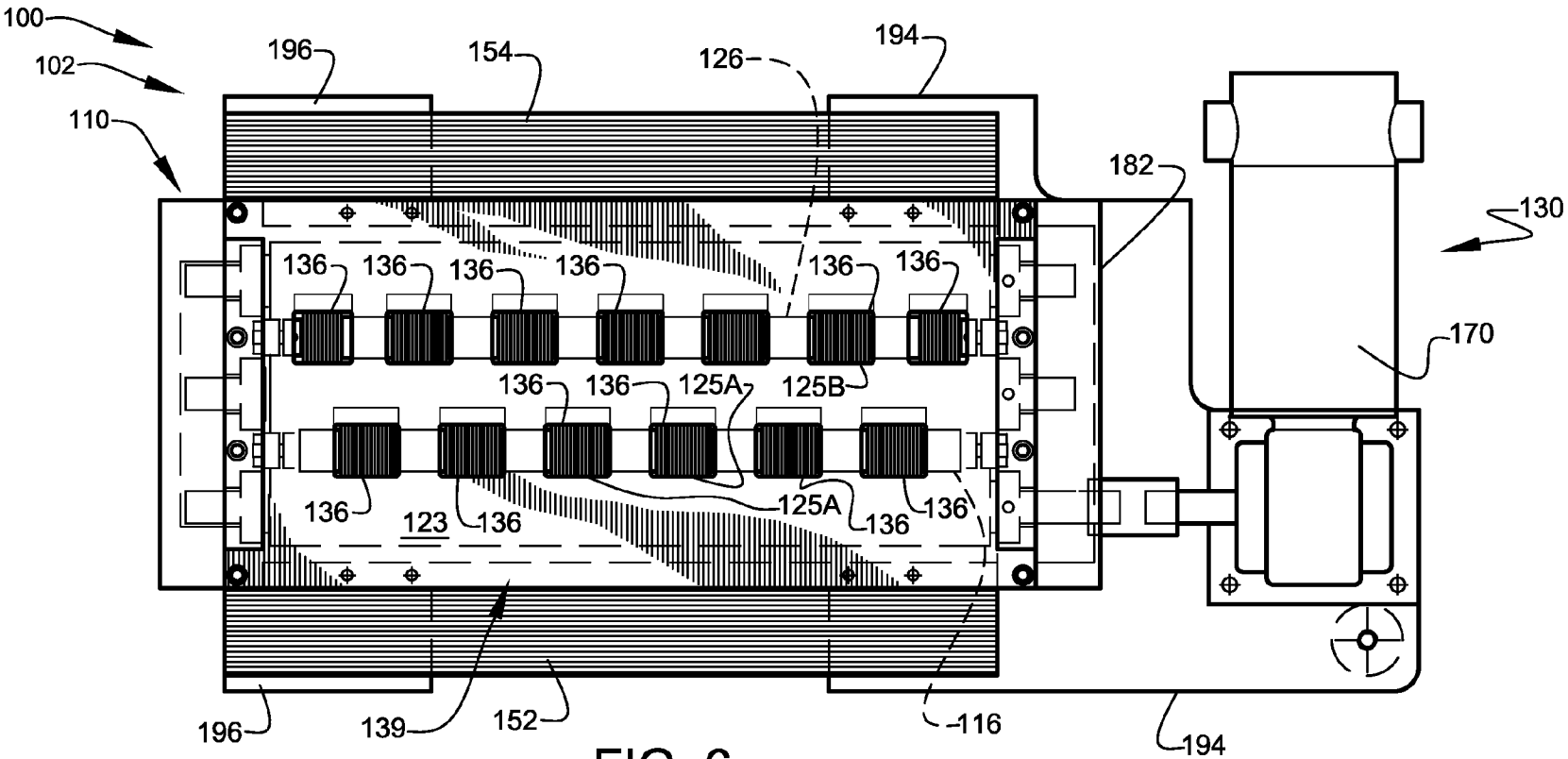
FIG. 6 shows a top view of the high-energy sheet magnetizer of FIG. 4 with the upper magnetizer unit removed from the lower magnetizer base assembly.

FIG. 6 shows a top view of high-energy sheet magnetizer 102 of FIG. 4 with upper magnetizer unit 112 removed from lower magnetizer base assembly 110 to expose lower magnetizer banks 136. Visible in FIG. 6 is the preferred positioning of second magnet bar 116 and fourth magnet bar 126 within magnetizer base-assembly 110. Note that magnetizer base-assembly 110 maintains second magnet bar 116 and fourth magnet bar 126 in substantially parallel alignment at a preferred axis-to-axis spacing substantially identical to that of first magnet bar 114 and third magnet bar 127, as shown.

Preferably, the substantially horizontal deck surface 123 is defined by the upper plane of apertured cover plate 139, as shown. Preferably, apertured cover plate 139 comprises a set of rectangular-shaped openings 125A and a set of rectangular-shaped openings 125B preferably arranged in an offset configuration, as shown. Preferably, openings 125A allow the magnetizer banks 136 of second magnet bar 116 to project upwardly through apertured cover plate 139 to contact flexible magnetic sheet 104, as shown. Preferably, openings 125B allow the magnetizer banks 136 of fourth magnet bar 126 to project upwardly through apertured cover plate 139 to contact flexible magnetic sheet 104, as shown.

Figure 8:
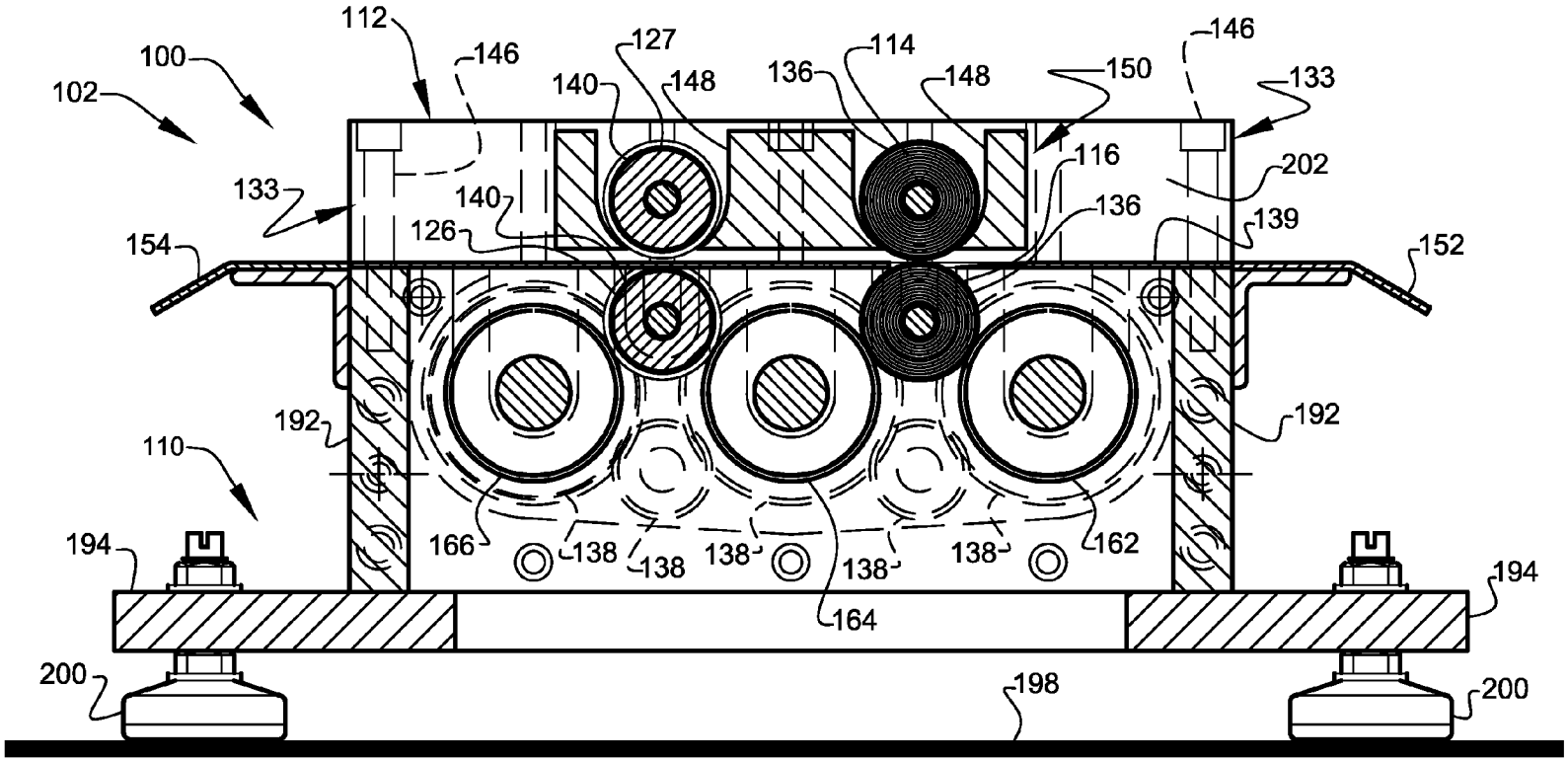
FIG. 8 is a sectional view through the section 8-8 of FIG. 4 showing preferred internal arrangements of the high-energy sheet magnetizer.

Preferably, entry of flexible magnetic sheet 104 to feed path 122 is facilitated by a downwardly projecting entry ramp 152, preferably mounted to the side of magnetizer base-assembly 110, at an elevation preferably matching deck surface 123 (see also FIG. 8). Exit of the magnetized flexible magnetic sheet 104 from deck surface 123 is preferably facilitated by a downwardly projecting exit ramp 154, also preferably mounted to the opposite side of magnetizer base-assembly 110; at an elevation preferably matching deck surface 123 (see again FIG. 8).

Figure 7:
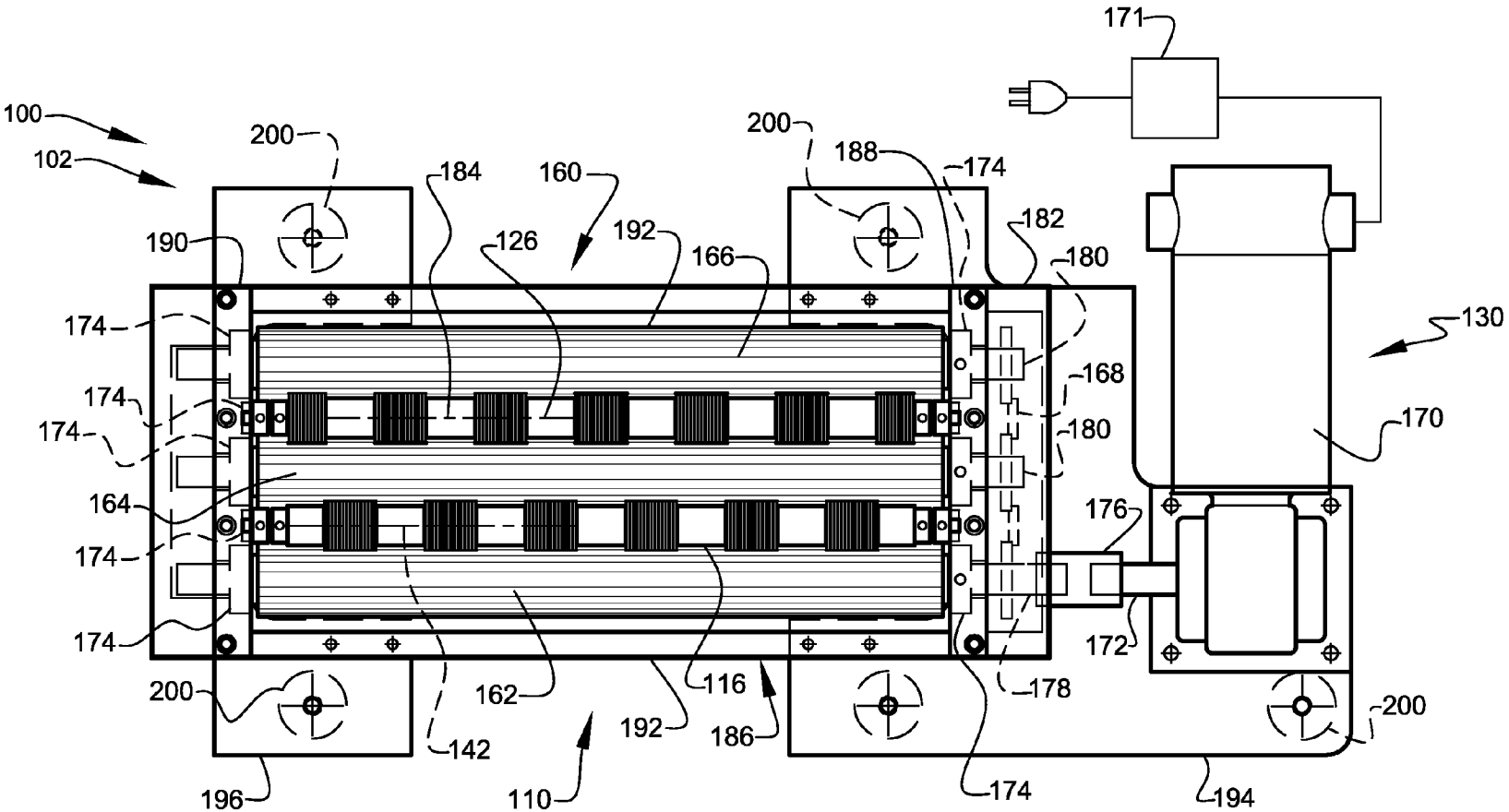
FIG. 7 shows a top view of the high-energy sheet magnetizer of FIG. 4 with the apertured cover plate removed to expose the magnetic feed mechanism of the lower magnetizer base assembly.

FIG. 7 shows a top view of high-energy sheet magnetizer 102 of FIG. 4 with apertured cover plate 139 removed to expose magnetic feed mechanism 160 of lower magnetizer base assembly 110.

Magnetic feed mechanism 160 preferably includes second magnet bar 116, fourth magnet bar 126, powered rotator assembly 130, first resilient roller 162, second resilient roller 164, third resilient roller 166, and gear assembly 168, as shown.

It is again helpful to note that second magnet bar 116 and fourth magnet bar 126 are preferably adapted to advance flexible magnetic sheet 104 along feed path 122. Magnetic feed mechanism 160 is preferably adapted to enable powered rotation of second magnet bar 116 and fourth magnet bar 126.

Preferably, powered rotator assembly 130 comprises electrically-driven motor 170, motor control 171, and output shaft 172, as shown. Preferably, output shaft 172 is adapted to transmit rotational torque forces produced by electrically-driven motor 170 to first resilient roller 162, as shown. A sleeve-type coupler 176 is preferably used to join output shaft 172 to an extended input shaft 178 of first resilient roller 162, as shown.

Preferably, the powered first resilient roller 162 is rotationally supported within magnetizer base-assembly 110 by a set of low-friction bearings 174, as shown. Preferably, the idler rollers, preferably comprising both second resilient roller 164 and third resilient roller 166 are similarly supported within magnetizer base-assembly 110 by low-friction bearings 174, as shown. Preferably, the rotational axes of first resilient roller 162, second resilient roller 164, and third resilient roller 166 are substantially parallel, as shown. In addition, first resilient roller 162, second resilient roller 164, and third resilient roller 166 are preferably positionally fixed relative to magnetizer base-assembly 110, as shown.

Preferably, second resilient roller 164 and third resilient roller 166 each comprise shaft extensions 180 that preferably project into gear housing 182, as shown. Extended input shaft 178 of first resilient roller 162 preferably extends through gear housing 182 as it projects horizontally to engage sleeve-type coupler 176, as shown.

Preferably, first resilient roller 162, second resilient roller 164, and third resilient roller 166 are rotationally coupled by operable engagements with gear assembly 168, as shown. Preferably, gear assembly 168 comprises an arrangement of intermeshed toothed gears located within gear housing 182, as shown. Gear assembly 168 preferably functions as a rotation-rate coordinator, preferably functioning to coordinate the rotation rates of first resilient roller 162, second resilient roller 164, and third resilient roller 166 during operation. Preferred gearing arrangements of gear assembly 168 are described in greater detail in FIG. 17.

Preferably, second magnet bar 116 is rotationally mounted within magnetizer base-assembly 110 by low-friction bearings 174, as shown. Second magnet bar 116 preferably comprises a position between first resilient roller 162 and second resilient roller 164, as shown. Preferably, second longitudinal axis 142 is substantially parallel to the longitudinal axis of first resilient roller 162 and second resilient roller 164, as shown. Furthermore, second magnet bar 116 is preferably positioned to be in direct contact with the outer circumferential face of both first resilient roller 162 and second resilient roller 164 (as best illustrated in the sectional view of FIG. 8). Preferably, first resilient roller 162 and second resilient roller 164 are structured and arranged to rotate second magnet bar 116 by frictional contact, as shown.

Preferably, fourth magnet bar 126 is similarly mounted within magnetizer base-assembly 110 by low-friction bearings 174, as shown. Fourth magnet bar 126 preferably comprises a position between second resilient roller 164 and third resilient roller 166, as shown. Preferably, fourth longitudinal axis 184 of fourth magnet bar 126 is substantially parallel to the longitudinal axes of second resilient roller 164 and third resilient roller 166, as shown. Furthermore, fourth magnet bar 126 is preferably positioned to be in direct contact with the outer circumferential faces of both second resilient roller 164 and third resilient roller 166 (as best illustrated in the sectional view of FIG. 8). Preferably, second resilient roller 164 and third resilient roller 166 are structured and arranged to rotate fourth magnet bar 126 by frictional contact, as shown. Thus, rotation of first resilient roller 162, by the application of torque on extended input shaft 178, preferably induces powered rotation in second resilient roller 164, third resilient roller 166, second magnet bar 116, and fourth magnet bar 126, as shown.

Electrically-driven motor 170 preferably comprises a direct current (DC) gearmotor, more preferably, a 140 rpm, 90 V direct current, right-angle gear motor such as those produced by the Dayton Electric Corporation of Niles Ill. The rotational output of electrically-driven motor 170 is preferably controlled by motor control 171, as shown. Preferably, motor control 171 comprises a solid-state speed controller adapted to convert an alternating current (AC) line-voltage input to full wave direct-current power compatible with electrically-driven motor 170. Preferred motor controllers suitable for use with preferred embodiments described herein include DC speed controllers produced by the Dayton Electric Corporation of Niles Illinois.

Figures 17, 18, 19:
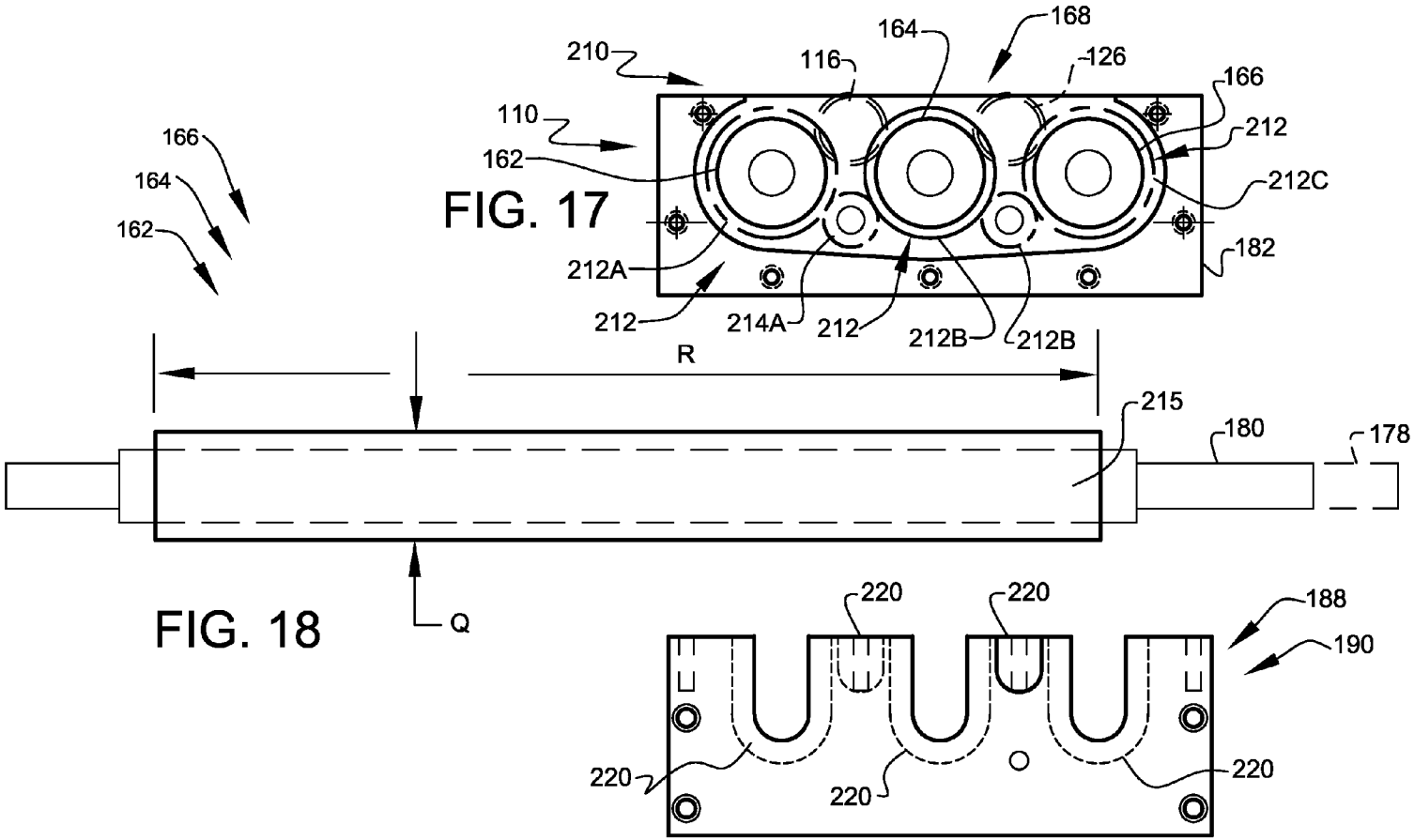
FIG. 17 shows a side view of the gear assembly of the lower magnetizer base assembly.
FIG. 18 shows top view of a resilient roller of the lower magnetizer base assembly.
FIG. 19 shows a side view of an end plate of the lower magnetizer base assembly.

Magnetizer base-assembly 110 preferably comprises a rigid and substantially rectangular support frame 186 comprising first endplate 188, second endplate 190 and two side plates 192 preferably extending therebetween, as shown. Preferably, first endplate 188 and second endplate 190 are adapted to support and position second resilient roller 164, third resilient roller 166, second magnet bar 116, and fourth magnet bar 126, as shown. A preferred configuration of first endplate 188 and second endplate 190 is shown in FIG. 19.

Preferably, support frame 186 is rigidly mounted to first base plate 194 and second base plate 196, as shown. The preferred extended configuration of first base plate 194 provides a rigid mounting point for electrically-driven motor 170, as shown. Preferably, first base plate 194 and second base plate 196 comprise a set of adjustable feet 200 to facilitate leveling of the assembly prior to use, as shown.

FIG. 8 is a sectional view through the section 8-8 of FIG. 4 showing preferred internal arrangements of high-energy sheet magnetizer 102. Visible in the sectional view of FIG. 8 is upper magnetizer unit 112 mounted to magnetizer base-assembly 110 by mount assembly 133, first magnet bar 114 vertically aligned above second magnet bar 116, third magnet bar 127 vertically aligned above fourth magnet bar 126, magnetizer banks 136 of first magnet bar 114, spacers 140 of third magnet bar 127, spacers 140 of fourth magnet bar 126, magnetizer banks 136 of second magnet bar 116, preferred positioning of apertured cover plate 139, and cross support 150 of support frame 145. In addition, the sectional view of FIG. 8 shows the preferred mounting of entry ramp 152 and exit ramp 154 to side plates 192. Also visible in FIG. 8 is the preferred relationship between first resilient roller 162, second resilient roller 164 and second magnet bar 116. In addition, FIG. 8 shows the preferred relationship between second resilient roller 164, third resilient roller 166, and fourth magnet bar 126.

Support frame 186 is preferably constructed from one or more substantially rigid materials, preferably substantially non-magnetic materials, more preferably a non-magnetic metallic material, most preferably aluminum. Support frame 186 is preferably assembled using mechanical fasteners, as shown.

High-energy sheet magnetizer 102 is preferably designed to rest on the surface of a workbench or similar horizontal support surface 198, as shown. The preferred compact size of high-energy sheet magnetizer 102 is preferably designed facilitate the "in-house" use of the preferred embodiments by print shops that would typically outsource magnetization of flexible magnetic sheet 104 after printing.

FIG. 9 shows a top view of support frame 145 of upper magnetizer unit 112 of FIG. 4. FIG. 10 shows a side view of support frame 145. FIG. 11 is a sectional view through the section 11-11 of FIG. 9.

Support frame 145 preferably comprises a generally H-shaped configuration, preferably comprising an assembly of cross support 150 extending between two end supports 202, as shown in FIG. 9. For the 13-inch embodiment of high-energy sheet magnetizer 102, support frame 145 accommodates a feed path 122 having a width B of about 13 inches, as shown. Preferably, each receiver slot 148 comprises a width of about 1⅛ inch and a center-to-center spacing C of about 2 inches. Preferably, each receiver slot 148 is milled to comprise a lower radius to better accommodate the preferred circular outer conformation of the magnet bars, as shown. Cross support 150 preferably comprises an overall width D of about 4 inches, as shown.

Support frame 145 is preferably constructed from one or more substantially rigid materials, preferably substantially non-magnetic materials, more preferably a non-magnetic metallic material, most preferably aluminum.

Mount assembly 133 preferably comprises the bolted connections between end supports 202, first endplate 188, and second endplate 190 (of lower support frame 186).

Figure 12:
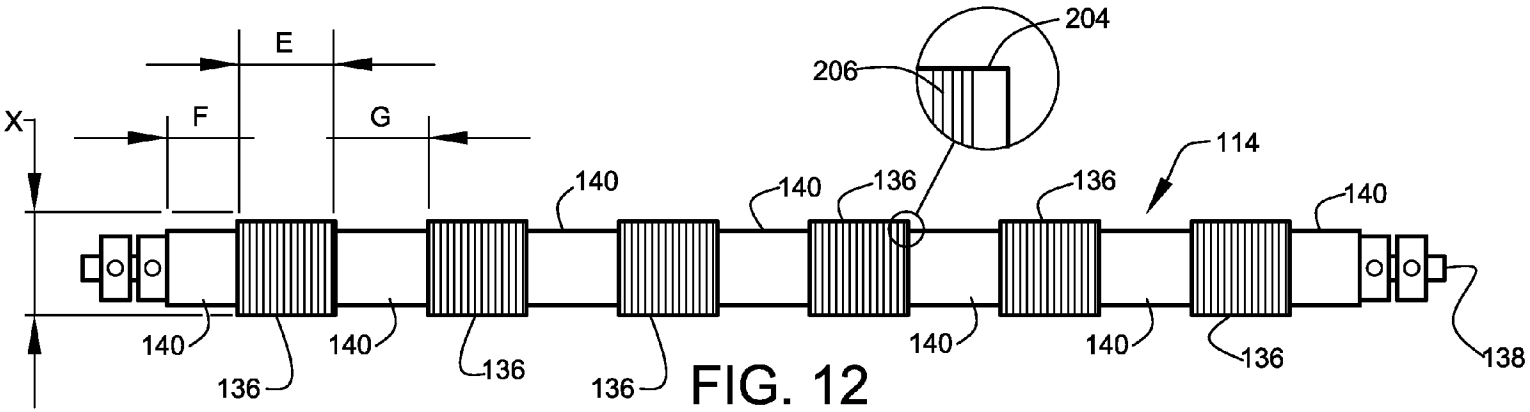
FIG. 12 shows a top view of a first magnet bar (and also representative of a second magnet bar) according to the preferred embodiment of FIG. 4.
Figure 13:
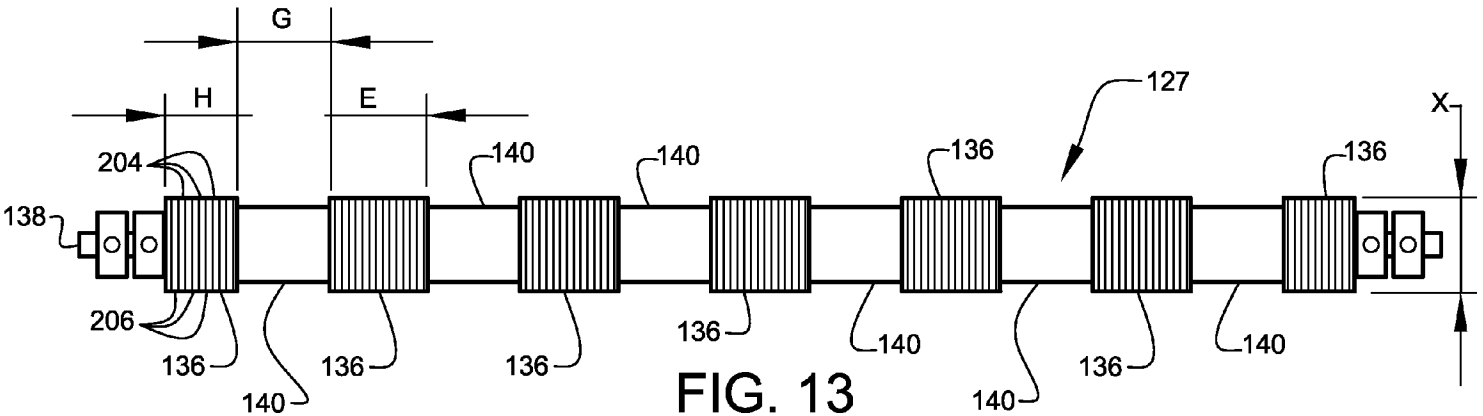
FIG. 13 shows a top view of a third magnet bar (also representative of a fourth magnet bar) according to the preferred embodiment of FIG. 4.

FIG. 12 shows a top view of first magnet bar 114(and also representative of second magnet bar 116) according to the preferred embodiment of FIG. 4. FIG. 13 shows a top view of third magnet bar 127 (also representative of fourth magnet bar 126) according to the preferred embodiment of FIG. 4.

For the 13-inch embodiment of high-energy sheet magnetizer 102, first magnet bar 114 comprises six magnetizer banks 136 and seven spacers 140, as shown. Preferably, each field-producing bank 136 of first magnet bar 114 comprises 15 flux-conducting plates, hereinafter identified as circular washers 204, each circular washer 204 having a thickness of about 0.03 inches, and 14 magnetic plates, hereinafter identified as circular magnets 206, each circular magnet 206 having a thickness of about 0.04 inches. Preferably, circular magnets 206 and circular washers 204 are laminated in alternating sequence. This produces magnetizer banks 136 comprising a preferred overall width E of about 1 inch, as shown.

End spacers 140 of first magnet bar 114 preferably comprise a width F of about 0.75 inches, as shown. Intermediate spacers 140 of first magnet bar 114 preferably comprise a width G of about 0.98 inch, as shown.

Third magnet bar 127 preferably comprises seven magnetizer banks 136 and seven spacers 140, as shown. The magnetizer banks 136 at each end of third magnet bar 127 preferably comprise 11 circular washers 204 each having a thickness of about 0.031 inches, and 10 circular magnets 206 each having a thickness of about 0.042 inches. This preferably produces two field-producing banks 136, at each end of third magnet bar 127, each one having an overall thickness H of about 0.76 inches, as shown. All spacers 140 of third magnet bar 127 preferably comprise a width G of about 0.98 inch, as shown.

Preferably, circular washers 204 of magnetizer banks 136 comprise an outer diameter X of about 1 inch. Preferably, circular washers 204 of magnetizer banks 136 preferably comprise at least one magnetically-conductive material, most preferably steel.

Preferably, circular magnets 206 of magnetizer banks 136 also comprise an outer diameter of about 1 inch. Preferably, circular magnets 206 comprise a permanent magnet, more preferably a neodymium-iron-boron [Nd—Fe—B] permanent magnet, alternately preferably, a samarium-cobalt [Sm—Co] permanent magnet, alternately preferably, an alnico permanent magnet, alternately preferably, a hard ferrite [ceramic] permanent magnet.

Permanent magnets suitable for use in the preferred embodiments described herein include commercially available products produced by Dexter Magnetic Technologies of Fremont Calif. Upon reading the teachings of this specification, those of ordinary skill in the art will now understand that, under appropriate circumstances, considering such issues as intended use, cost, advances in magnet technology, etc., other magnetic field generation arrangements, such as electromagnets, magnetic composites, etc., may suffice.

Magnetizer banks 136 are preferably constructed to have an overall preferred width as close to 1 inch as possible. Shim washers are preferably used, on the outside of magnetizer banks 136, to provide minor width adjustments needed to achieve the preferred widths. Magnetizer banks 136 are preferably assembled such that the magnet poles of circular magnets 206 are oriented North/South (relative to each other), as if each magnetizer bank 136 comprised a single magnetic element.

Preferably, spacers 140, circular magnets 206, and circular washers 204 are coaxially engaged on central bar 138, as shown. Preferably, central bar 138 comprises a cylindrical rod, more preferably a "316" stainless steel, ¼-inch diameter rod, as shown. Preferably, spacers 140 comprise hollow cylindrical members having an outer diameter of about 0.8 inches. Spacers 140 preferably comprise steel.

Figure 14:
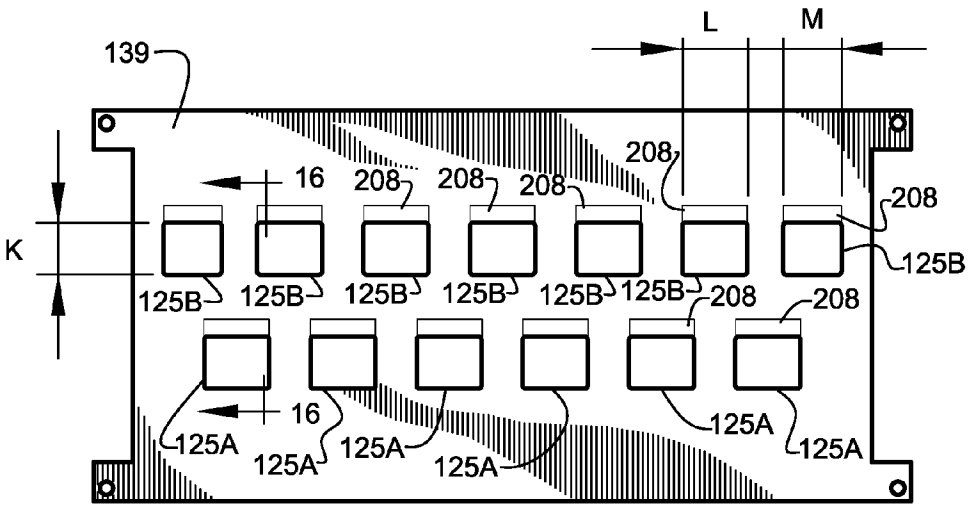
FIG. 14 shows a top view of the apertured cover plate according to the preferred embodiment of FIG. 4.

FIG. 14 shows a top view of apertured cover plate 139 according to the preferred embodiment of FIG. 4. Appertured cover plate 139 is preferably constructed from a substantially rigid sheet of non-metallic material, most preferably a brass sheet. Preferably, apertured cover plate 139 comprises a uniform thickness J of about 0.6 inches, as shown. Preferably, apertured cover plate 139 comprises a set of rectangular-shaped openings 125A and a set of rectangular-shaped openings 125B preferably arranged in an offset configuration, as shown. Preferably, openings 125A allow the magnetizer banks 136 of second magnet bar 116 to project upwardly through apertured cover plate 139 to contact flexible magnetic sheet 104, as shown. The preferred spacing of openings 125A preferably match the spacing of magnetizer banks 136 of second magnet bar 116. Preferably, openings 125B allow the magnetizer banks 136 of fourth magnet bar 126 to project upwardly through apertured cover plate 139 to contact flexible magnetic sheet 104, as shown. The preferred spacing of openings 125B preferably match the spacing of magnetizer banks 136 of fourth magnet bar 126.

Openings 125A preferably comprise an effective open width K of about 1 inch and an effective open length L of about 1.25 inches, as shown. Openings 125B also preferably comprise an effective open width K of about 1 inch and an effective open length L of about 1.25 inches, with the exception of the end apertures. Recall that the magnetizer banks 136 at each end of fourth magnet bar 126 preferably comprise a narrow width, as shown. For this reason, the two end apertures of openings 125B preferably comprise a length M of about 1.12 inches, as shown.

Preferably, the trailing edge of each opening 125A and opening 125B preferably comprises an angled ramp 208, as shown. Preferably, angled ramp 208 assists in maintaining smooth and consistent feed performance by reducing the tendency of flexible magnetic sheet 104 to contact the trailing edge of the apertures due to magnetic adherence to the magnetizer banks 136. Preferably, angled ramp 208 comprises a tapered cut having a length N of about 5/16 inch. Alternately preferably, angled ramp 208 is formed by modifying a section of apertured cover plate 139 two allow bending of the section downward a distance P of about 1/16 inch, as shown in FIG. 15 and FIG. 16.

Figure 15:
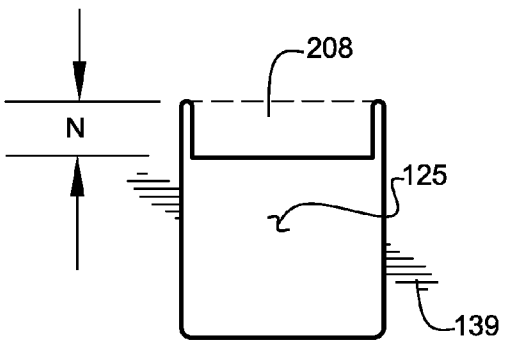
FIG. 15 shows a detailed view of a ramped aperture of the apertured cover plate of FIG. 14.
Figure 16:
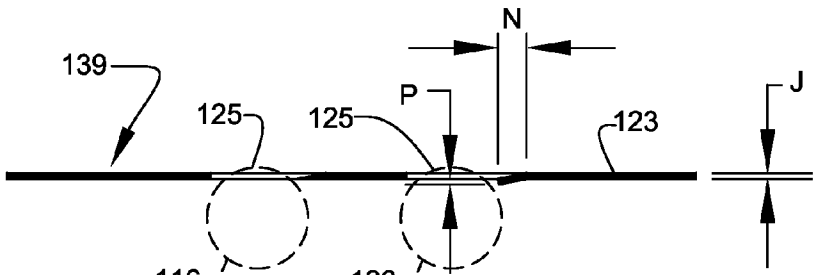
FIG. 16 shows a diagrammatic sectional view illustrating two preferred aperture ramping methods of the apertured cover plate of FIG. 14.

FIG. 15 shows a detailed view of the alternate "bent" aperture of the apertured cover plate of FIG. 14. FIG. 16 shows a diagrammatic sectional view illustrating the two preferred aperture ramping methods of apertured cover plate 139.

FIG. 17 shows a side view of gear assembly 168 of lower magnetizer base-assembly 110. Preferably, gear assembly 168 comprises a train of intermeshed toothed gears 210, preferably located within gear housing 182, as shown. The mechanical train of gear assembly 168 preferably functions as a rotation-rate coordinator functioning to coordinate the rotation rates of first resilient roller 162, second resilient roller 164, and third resilient roller 166 during operation.

Preferably, toothed gears 210 comprise 14.5-degree pressure angle spur gears. Preferably, each resilient roller comprises a roller gear 212, as shown. Preferably, each roller gear 212 comprises a 20-diameter pitch by 36 teeth by 1.8 pitch-diameter gear-element. Preferably, power applied to first resilient roller 162 is transferred by first roller gear 212A to second roller gear 212B (of second resilient roller 164) by first transfer gear 214A, as shown. Preferably, power applied to second resilient roller 164 is transferred by second roller gear 212B to third roller gear 212C (of third resilient roller 166) by second transfer gear 214B, as shown. Preferably, both first transfer gear 214A and first transfer gear 214B comprise a 20-diameter pitch by 15 teeth by 0.75 pitch-diameter gear-element. Upon reading the teachings of this specification, those of ordinary skill in the art will now understand that, under appropriate circumstances, considering such issues as intended use, cost, etc., other coordination arrangements, such as belts, electronically controlled step motors, physical surface contact between rollers, etc., may suffice.

FIG. 18 shows top view of a preferred resilient roller configuration of lower magnetizer base-assembly 110. Preferably, first resilient roller 162, second resilient roller 164, and third resilient roller 166 each comprise an elongated cylindrical member having a resilient outer surface 215, as shown. Preferably, resilient outer surface 215 comprises a synthetic rubber, most preferably a neoprene material having about 75-durometer composition. Preferably, resilient outer surface 215 comprises an outer diameter Q of about 1.5 inches, as shown. Preferably, first resilient roller 162, second resilient roller 164, and third resilient roller 166 each comprise shaft extensions 180 that preferably project into gear housing 182, as previously described. Extended input shaft 178 of first resilient roller 162 preferably extends through gear housing 182 as it projects horizontally to engage sleeve-type coupler 176, as previously described. For the 13-inch embodiment of high-energy sheet magnetizer 102, resilient outer surface 215 comprises a width R of about 13 inches.

FIG. 19 shows a side view of first endplate 188 and second endplate 190 of lower magnetizer base assembly 110. Preferably, first endplate 188 and second endplate 190 each comprise a substantially symmetrical arrangement of recessed receivers 220 adapted to receive and position low-friction bearings 174 of the above-described rotating elements of lower magnetizer base assembly 110, as shown. Preferably, first endplate 188 and second endplate 190 are each constructed from a solid billet of non-magnetic material, more preferably a non-magnetic metal, most preferably a 0.75-inch thick aluminum block. Preferably, recessed receivers 220 are preferably milled to a depth of about 0.25 inch.

Figure 20:
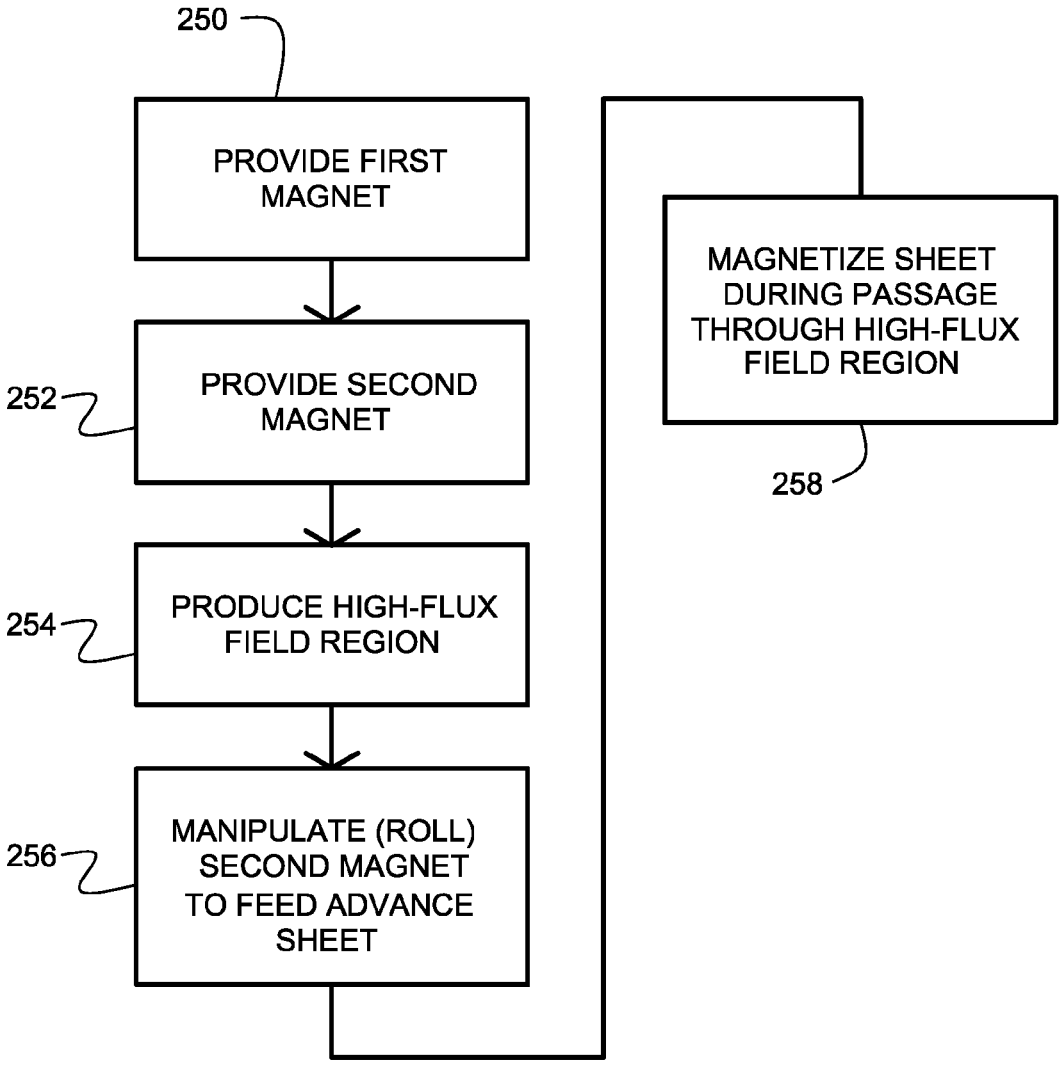
FIG. 20 shows a flow diagram illustrating a preferred method of operation according to the present invention.

FIG. 20 shows a flow diagram illustrating a preferred method of operation according to the present invention. Upon reading the prior teachings of this specification, those of ordinary skill in the art will now understand that the preferred embodiments, as described herein, preferably enable at least one method related to magnetization of flexible magnetic sheet 104, such method comprising the following series of preferred steps. In a first preferred step, identified herein as step 250, high-energy sheet magnetizer 102 is preferably structured and arranged to produce at least one first magnetic field by providing at least one first magnet. Furthermore, the preferred arrangements of high-energy sheet magnetizer 102 preferably provide at least one second magnet structured and arranged to produce at least one second magnetic field, as noted in preferred step 252. Preferably, the first and second magnets produce at least one high-flux field region by the geometrical positioning, preferably vertical alignment, of the magnets by upper magnetizer unit 112 and magnetizer base-assembly 110. As previously described, this preferred arrangement of magnet preferably produces at least one high-flux gap between the magnets, as noted in preferred step 254.

Preferably, at least one of the second magnets, most preferably at least one of the lower magnets is manipulated to feed advance flexible magnetic sheet 104 through the high-flux gap, as indicated by preferred step 256. This is preferably accomplished by rotating the second magnet after forming at least one frictional surface contact between at least one of the second magnets and the planar unprinted side 108 of flexible magnetic sheet 104. This preferably results in at least partial magnetization of flexible magnetic sheet 104, as indicated in preferred step 258.

Figure 21:
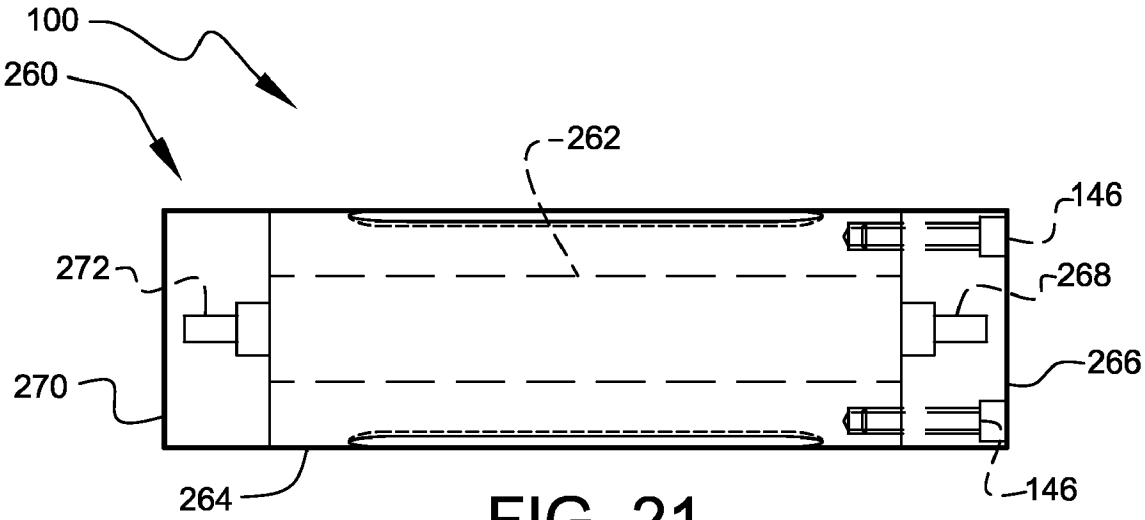
FIG. 21 shows a top view of a modular hand-held magnetizer according to a preferred embodiment of the present invention.
Figure 22:
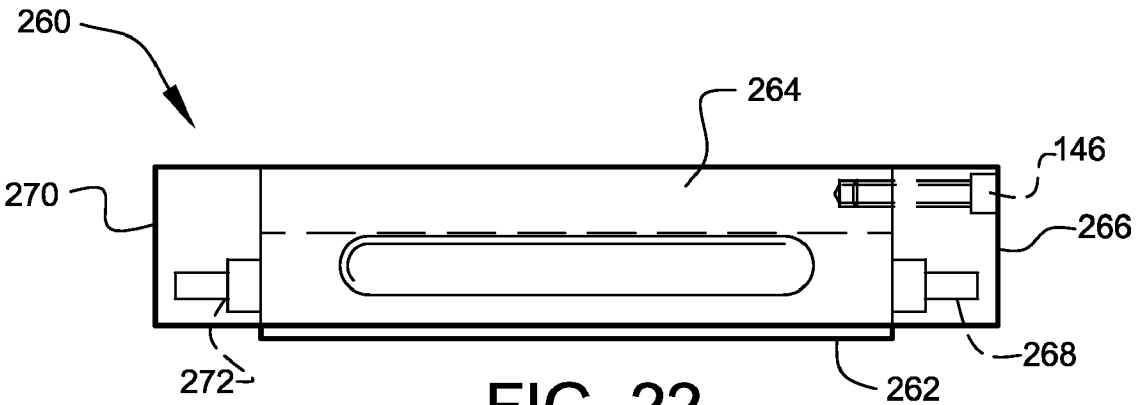
FIG. 22 shows a side view of the modular hand-held magnetizer of FIG. 21.
Figure 23:
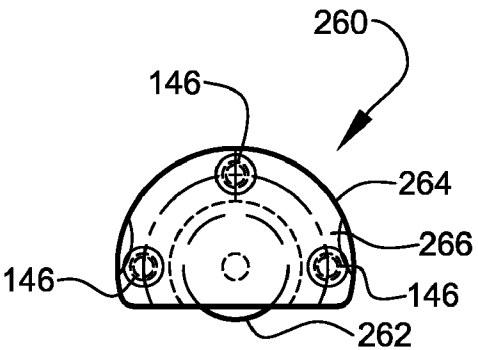
FIG. 23 shows an end view illustrating the modular hand-held magnetizer of FIG. 21.
Figure 24A:
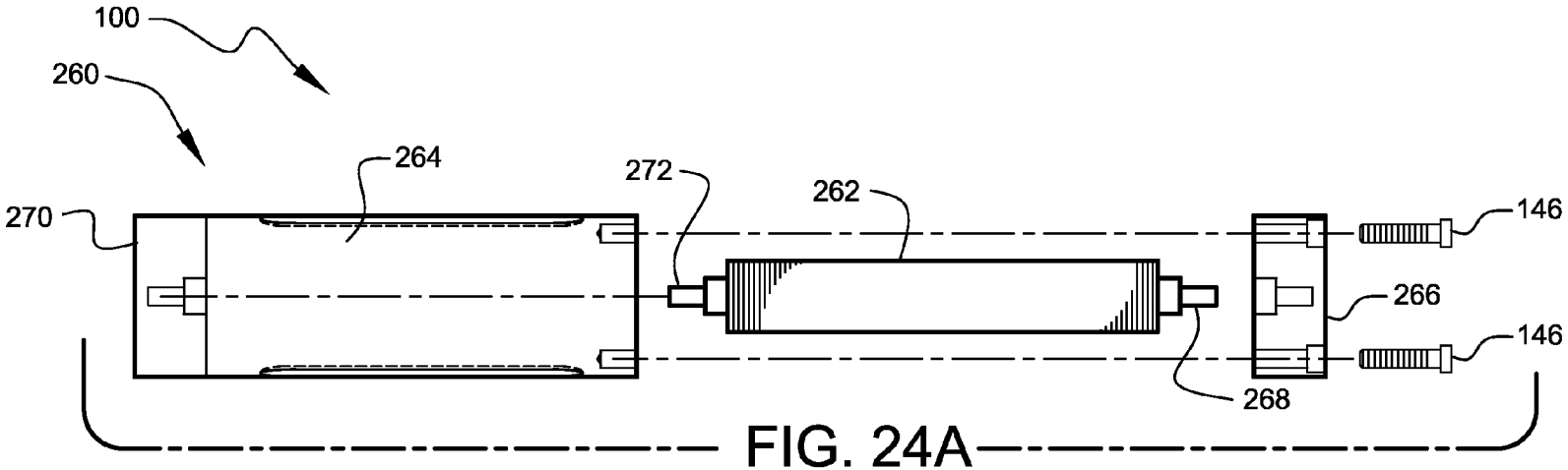
FIG. 24A shows an exploded view of the modular hand-held magnetizer of FIG. 21.

FIG. 21 shows a top view of a modular hand-held magnetizer 260 according to a preferred embodiment of the present invention. FIG. 22 shows a side view of modular hand-held magnetizer 260 of FIG. 21. FIG. 23 shows an end view illustrating modular hand-held magnetizer 260 of FIG. 21. FIG. 24A shows a first exploded view of modular hand-held magnetizer 260 of FIG. 21.

Figure 24B:
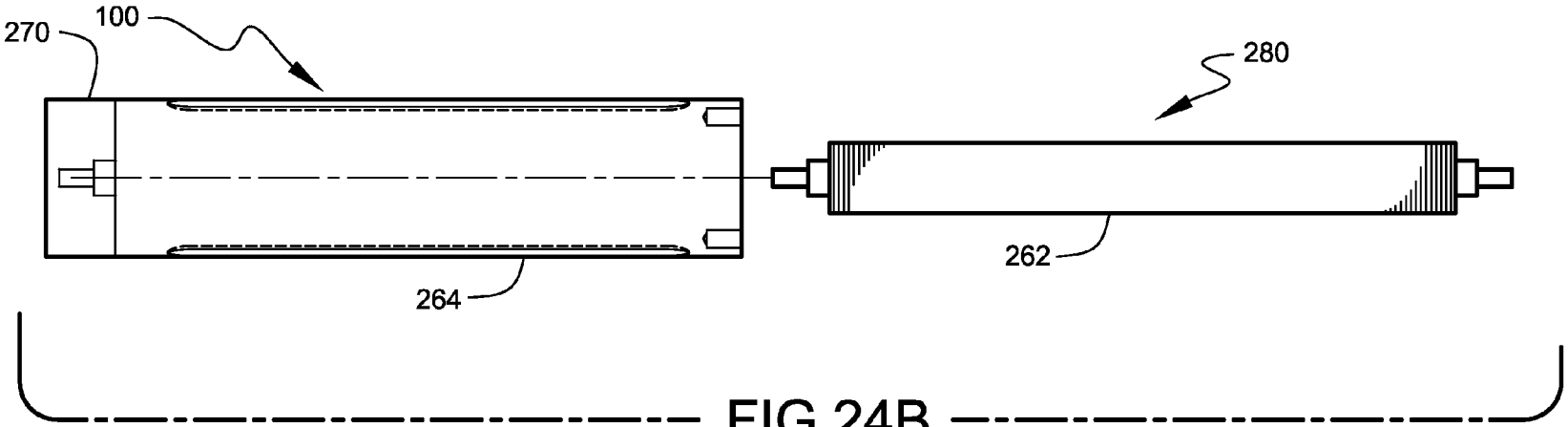
FIG. 24B shows a second exploded view illustrating a set of alternate modular components usable to generate alternate preferred embodiments of the modular hand-held magnetizer of FIG. 21.

FIG. 24B shows a second exploded view illustrating a set of alternate modular components 280, usable to generate alternate preferred embodiments of modular hand-held magnetizer 260, according to preferred embodiments of sheet magnetizer system 100.

Preferably, modular hand-held magnetizer 260 provides a relatively small, highly portable, and relatively inexpensive device preferably adapted to magnetize flexible magnetic sheet 104 after printing. Preferably, modular hand-held magnetizer 260 comprises a single cylindrical magnet bar 262 rotatably engaged within a hand-holdable magnetizer body 264, as shown.

Preferably, hand-holdable magnetizer body 264 comprises an elongated generally cylindrical having an interior cavity adapted to hold cylindrical magnet bar 262, as shown. Preferably, hand-holdable magnetizer body 264 comprises end wall 270, preferably permanently mounted to hand-holdable magnetizer body 264, as shown.

Preferably, modular end cap 266 is adapted to be removably mounted to the end of hand-holdable magnetizer body 264 opposite end wall 270, as shown. Preferably, modular end cap 266 comprises a recessed socket structured and arranged to rotationally engage first end 268 of cylindrical magnet bar 262, as shown. Preferably, end wall 270 comprises a similar socket structured and arranged to rotationally engage second end 272 of cylindrical magnet bar 262, as shown. Preferably, modular end cap 266 is removably mounted to the end of hand-holdable magnetizer body 264 using a set of threaded fasteners 146 passing through modular end cap 266 to threadably engage hand-holdable magnetizer body 264, as shown.

Preferably, modular hand-held magnetizer 260 is assembled by engaging second end 272 of cylindrical magnet bar 262 in the receiving socket of end wall 270, engaging first end 268 of cylindrical magnet bar 262 within the recessed socket of modular end cap 266, and affixing modular end cap 266 to hand-holdable magnetizer body 264, as shown.

Preferably, cylindrical magnet bar 262 comprises an alternating sequential lamination of magnetic plates and flux-conducting plates. Preferably, each magnetic plate comprises a high-strength permanent magnet and each flux-conducting plate preferably comprises a material exhibiting high permeability when saturated. Preferably, both magnetic plates and flux-conducting plates comprise substantially circular peripheral shapes, as shown. Preferably, each substantially circular magnetic plate and each substantially circular flux-conducting plate are substantially coaxial with the longitudinal axis of cylindrical magnet bar 262, as shown.

Preferably, modular hand-held magnetizer 260 is adaptable to generate hand-held magnetizers of differing lengths. Preferably, sheet magnetizer system 100 comprises sets of hand-holdable magnetizer body 264, of differing fixed lengths, and sets of matched length cylindrical magnet bars 262. Preferably, modular end cap 266 is structured and arranged to be utilized by all hand-holdable magnetizer bodies 264 and all cylindrical magnet bars 262 of the sets.

Upon reading the teachings of this specification, those of ordinary skill in the art will now understand that, the above described embodiments enable at least one preferred method of the present invention, preferably comprising the selecting from a set of hand-holdable bodies comprising differing fixed lengths, a fixed-length hand-holdable magnetizer body 264; selecting from a set of cylindrical magnet bars comprising differing fixed lengths, a cylindrical magnet bar 262 comprising a fixed length compatible with the selected fixed-length hand-holdable magnetizer body 264; engaging the second end of the selected cylindrical magnet bar 262 within the selected fixed-length hand-holdable magnetizer body 264; engaging the first end of the selected cylindrical magnet bar 262 within modular end cap 266; and mounting modular end cap 266 to the selected fixed-length hand-holdable magnetizer body 264.

This preferred method allows the user to produce a custom-width magnetizer the best matching the user's needs.

FIG. 24A shows a first exploded view of modular hand-held magnetizer 260 comprising modular end cap 266, a hand-holdable magnetizer body 264 of a first fixed length, and a cylindrical magnet bar 262 of compatible length. FIG. 24B shows a second exploded view illustrating a set of alternate modular components 280, usable to generate preferred alternate length embodiments of modular hand-held magnetizer 260. FIG. 24B shows a hand-holdable magnetizer body 264 of an alternate fixed length and an alternate cylindrical magnet bar 262 of compatible length. Preferably, alternate modular components 280 are utilized with modular end cap 266 to produce a wider embodiment of modular hand-held magnetizer 260.

Figure 25:
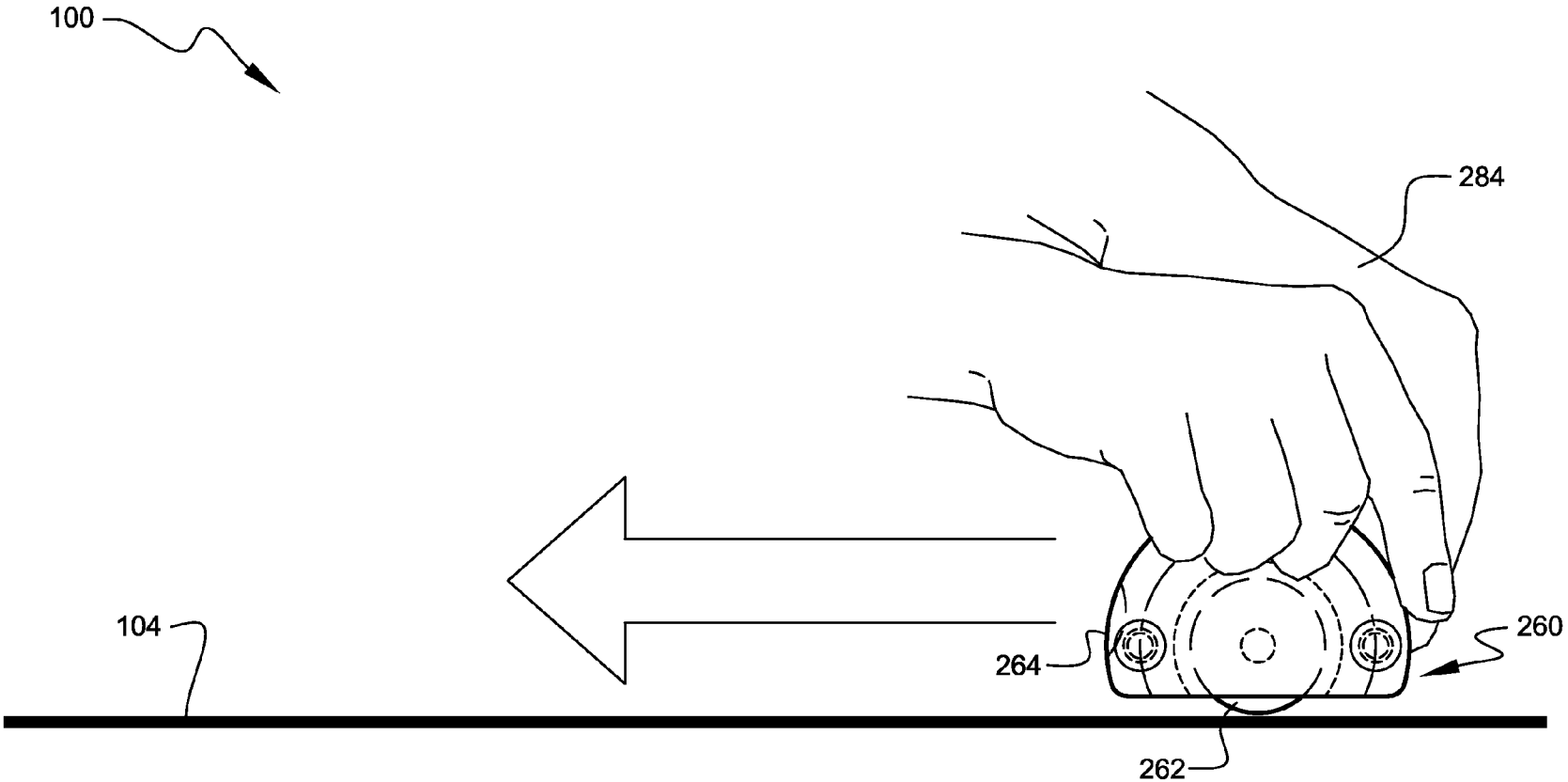
FIG. 25 illustrates the preferred use of the modular hand-held magnetizer of FIG. 21.

FIG. 25 illustrates the preferred use of modular hand-held magnetizer 260. In preferred use, user 284 hand grips hand-holdable magnetizer body 264 and positions cylindrical magnet bar 262 to contact the substantially planar surface of flexible magnetic sheet 104, as shown. Next, user 284 rolls cylindrical magnet bar 262 across the planar surface to at least partially magnetize flexible magnetic sheet 104.

Figures 26, 27:
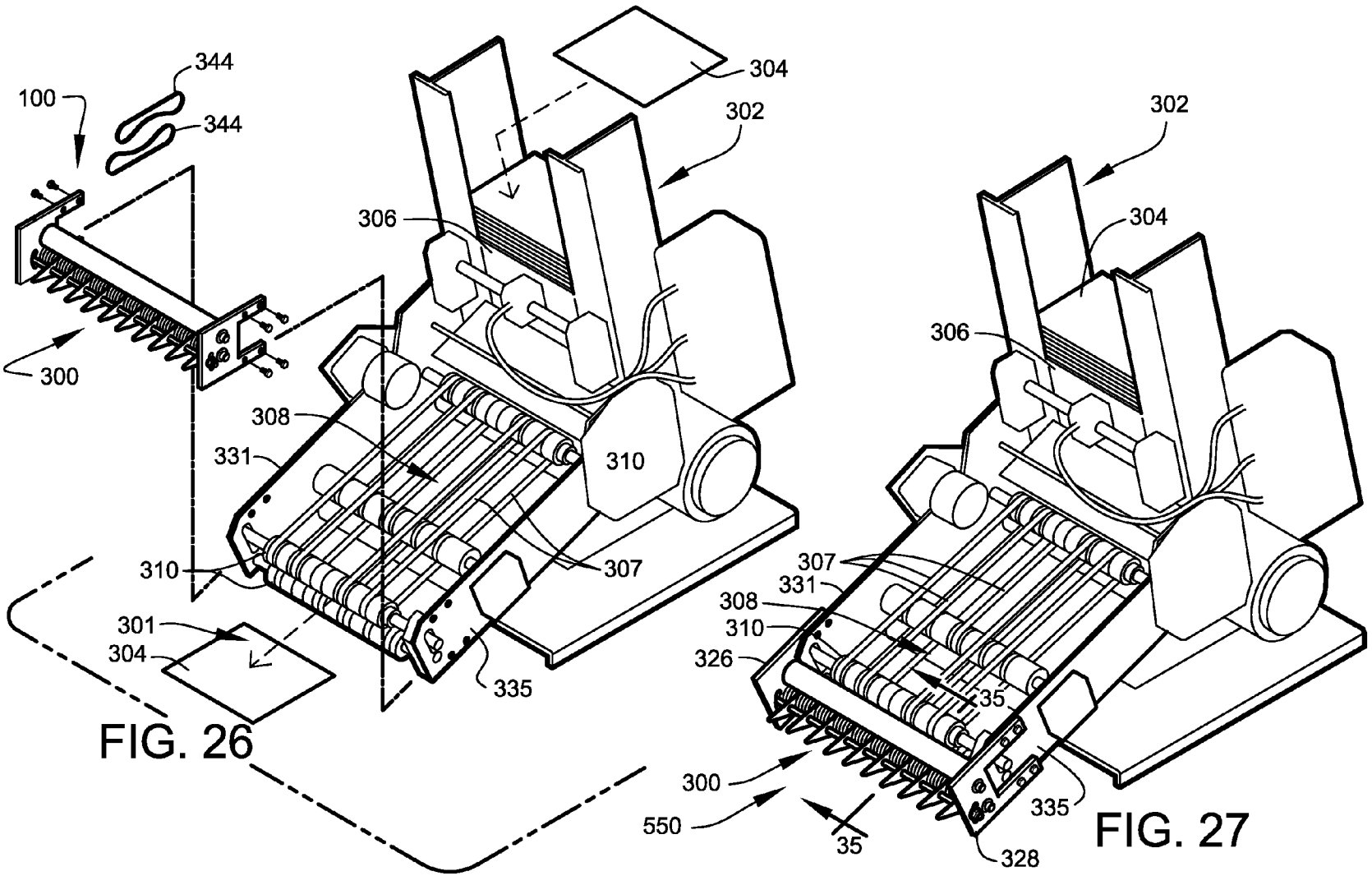
FIG. 26 shows a perspective view of a sheet magnetizer modification, used to update an existing friction-type sheet feeder to comprise sheet-magnetization capability, according to an alternate preferred embodiment of the present invention.
FIG. 27 shows a perspective view of the sheet magnetizer modification, mounted to an existing friction-type sheet feeder, according to the preferred embodiment of FIG. 26.

FIG. 26 shows a perspective view of sheet magnetizer modification 300, used to update existing friction-type sheet-handling device 302 to comprise sheet-magnetization capability, according to an alternate preferred embodiment of sheet magnetizer system 100. FIG. 27 shows a perspective view of sheet magnetizer modification 300, mounted to existing friction-type sheet-handling device 302, according to the preferred embodiment of FIG. 26.

Preferably, sheet magnetizer modification 300 is used to retrofit a friction-type batch feeder to enable the magnetization of sheets of flexible magnetizable material 304, during operation of the feeder. Such batch sheet feeders are commonly used in commercial/industrial applications such as packaging and print-finishing assembly lines. A preferred existing friction-type sheet-handling device 302 operates by transporting sheet material, typically one at a time, from a stack of sheets loaded into feeder magazine 306, along sheet transport path 308, to a selected discharge point 301, as shown. Within sheet transport path 308, sheets are conveyed through parallel sets of endless belts 307 engaged on a plurality of power-driven rollers 310, as shown.

Preferred existing friction-type sheet-handling devices 302 include units selected from the C350/C700 series of high-speed friction feeders produced by Longford International Ltd. of Toronto, Ontario Canada. Upon reading the teachings of this specification, those of ordinary skill in the art will now understand that, under appropriate circumstances, considering such issues as user preference, intended use, etc., other system arrangements, such as the retrofitting of sheet cutters, batch counters, special purpose conveyors, etc., may suffice.

Preferably, integration of sheet magnetizer modification 300 within existing friction-type sheet-handling devices 302 enables the magnetization of flexible magnetizable material 304 during movement of flexible magnetizable material 304 between feeder magazine 306 and the selected discharge point 301.

Figure 28:
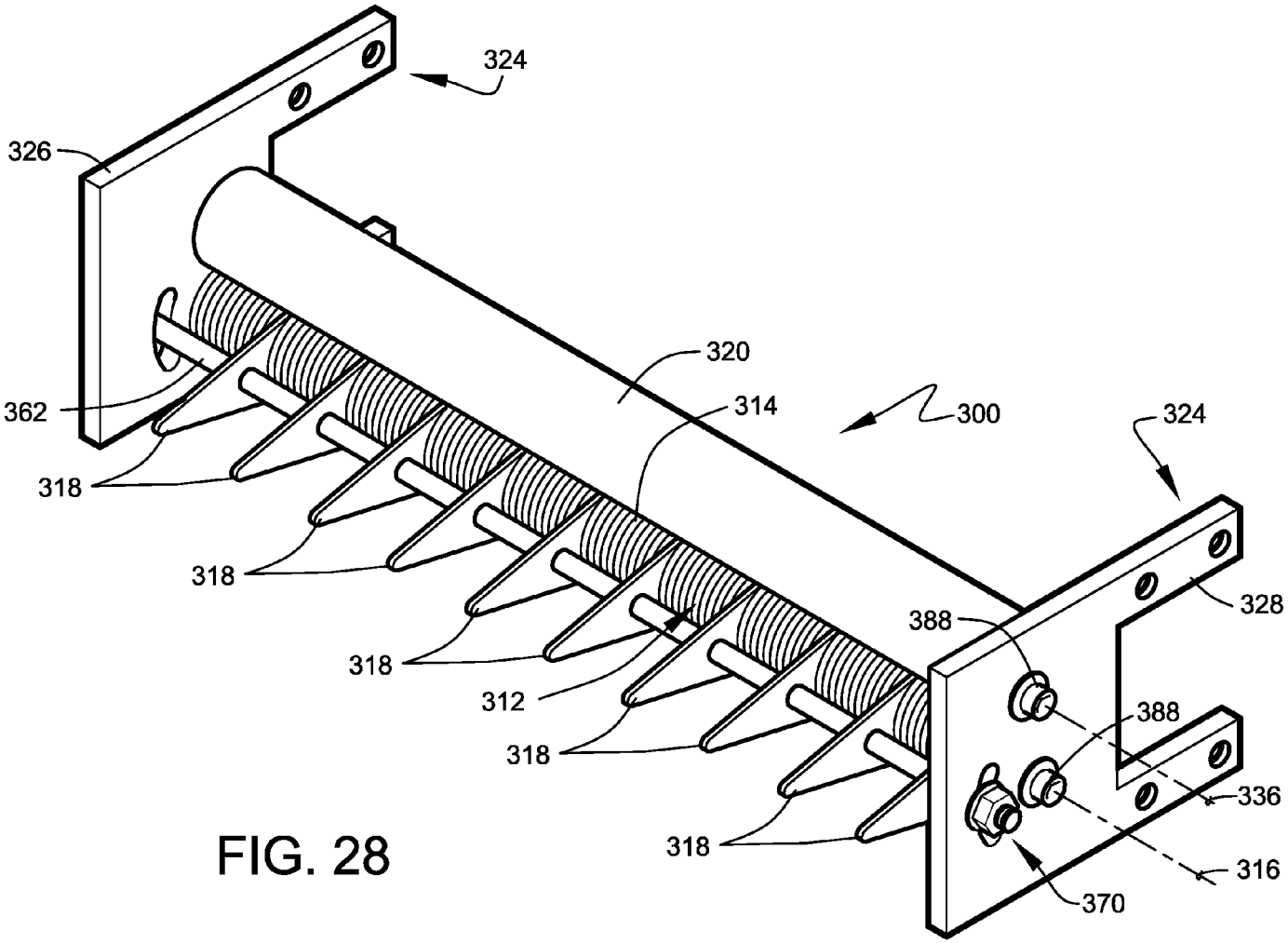
FIG. 28 shows a perspective view of the sheet magnetizer modification of FIG. 26.

FIG. 28 shows a perspective view of the primary assembly of sheet magnetizer modification 300. Preferably, sheet magnetizer modification 300 comprises at least one magnetic field source 312 adapted to generate at least one magnetic field usable to permanently magnetize flexible magnetizable material 304. Preferably, magnetic field source 312 comprises a rotatable magnet bar identified herein as field-producing roller 314, as shown. Preferably, field-producing roller 314 comprises first longitudinal axis 316, preferably oriented substantially perpendicular to the local direction of sheet motion within sheet transport path 308 (see FIG. 26). Preferably, field-producing roller 314 comprises a plurality of magnetic plates and flux-conducting plates (as best described in FIG. 31). Preferably, a plurality of separator members 318 are interspersed within the above-noted plates, as shown. Preferably, each separator member 318 is designed to assist in separating flexible magnetizable material 304 from field-producing roller 314 after magnetization of the sheet. This is generally necessary due to the tendency of flexible magnetizable material 304 to adhere to the magnet once magnetized.

In a somewhat modified preferred embodiment of sheet magnetizer modification 300, an additional roller, identified herein as press-down roller 320, is provided adjacent field-producing roller 314. Press-down roller 320 preferably serves a combination of functions including the formation of at least one magnetic circuit with such at least one magnetic roller, assisting in the maintaining of proper positioning of flexible magnetizable material 304 as it passes field-producing roller 314, and providing a means for frictional advancement of flexible magnetizable material 304, as discussed in a later section. Preferably, press-down roller 320 rotates about second rotational axis 336, as shown, also preferably oriented substantially perpendicular to the direction of movement of flexible magnetizable material 304 along sheet transport path 308.

Preferably, field-producing roller 314 (and the optionally provided press-down roller 320) are both rotationally held within mounting assembly 324, as shown. Preferably, mounting assembly 324 comprises first endplate 326 and second endplate 328, as shown. Preferably, mounting assembly 324 is used to mount field-producing roller 314 (and the optionally provided press-down roller 320) to existing friction-type sheet-handling device 302, as shown in FIG. 27.

Preferably, first endplate 326 and second endplate 328 function as "positioners" to situate field-producing roller 314 in a position relative to sheet transport path 308, so as to initiate at least one magnetic-field interaction between the magnetic field of field-producing roller 314 and flexible magnetizable material 304 as it moves to exit sheet transport path 308. In the preferred embodiment of FIG. 26, first endplate 326 and second endplate 328 are fastened to first side plate 331 and second side plate 335, respectively, of existing friction-type sheet-handling device 302, as best shown in FIG. 27.

Figure 29:
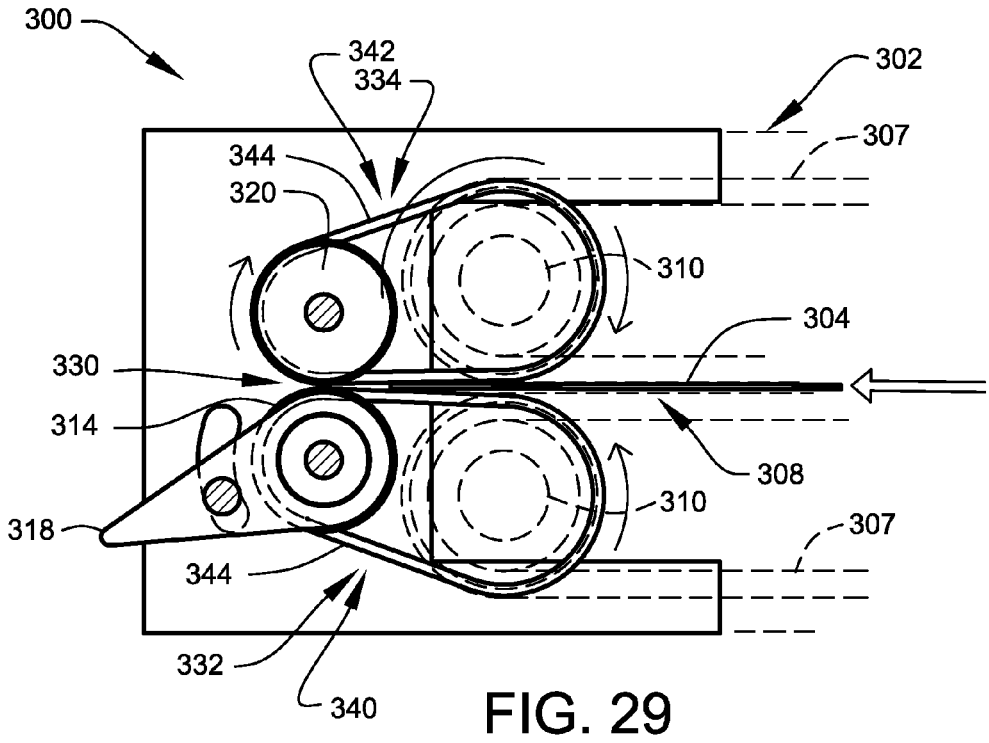
FIG. 29 shows a schematic sectional diagram illustrating the preferred operation of the sheet magnetizer modification of FIG. 26.
Figure 30:
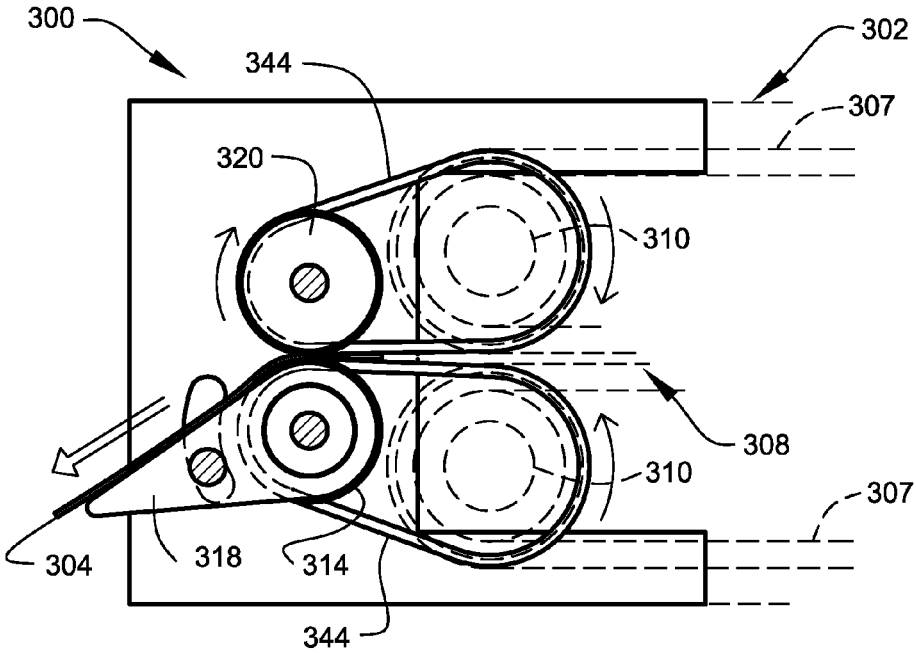
FIG. 30 shows a second schematic sectional diagram further illustrating the preferred operation of the sheet magnetizer modification of FIG. 26.

FIG. 29 shows a schematic sectional diagram illustrating the preferred operation of sheet magnetizer modification 300 of FIG. 26. FIG. 30 shows a second schematic sectional diagram further illustrating the preferred operation of sheet magnetizer modification 300 of FIG. 26.

Preferably, flexible magnetizable material 304 is moved along sheet transport path 308 (in the direction of the arrow) by frictional contact with a set of moving endless belts 307 (shown as dashed lines) of existing friction-type sheet-handling device 302. As previously noted, movement of the endless belts 307 is a result of their engagement on power-driven rollers 310, which are rotated by an electrical motor or equivalent source of mechanical power. Preferably, flexible magnetizable material 304 is advanced along sheet transport path 308 until it reaches the final pair of power driven rollers 310 at which point it is discharged to a position of engagement with field-producing roller 314 of sheet magnetizer modification 300. Preferably, flexible magnetizable material 304 is permanently magnetized by passage through the magnetic field generated by field-producing roller 314.

It is noted that, in the preferred embodiment of FIG. 29 and FIG. 30, the optionally preferred press-down roller 320 (at least embodying herein at least one field-conducting roller) has been provided, as shown. When press-down roller 320 is utilized, flexible magnetizable material 304 passes through air gap 330 formed between press-down roller 320 (the upper roller in FIG. 29) and field-producing roller 314 (the lower roller in FIG. 29), as shown (at least embodying herein at least one air gap structured and arranged to enable passage of such at least one substantially planar sheet of substantially flexible magnetizable material, therethrough).

Preferably, field-producing roller 314 comprises at least one first rotator assembly 332 structured and arranged to rotate field-producing roller 314, in at least one first direction, about first longitudinal axis 316, as shown. Preferably, press-down roller 320 comprises a similar rotator arrangement identified herein as second rotator assembly 334, as shown. Preferably, second rotator assembly 334 is structured and arranged to rotate press-down roller 320, in a direction opposite field-producing roller 314, as shown.

Preferably, both first rotator assembly 332 second rotator assembly 334 are powered by existing friction-type sheet-handling device 302, as shown. Preferably, first rotator assembly 332 comprises at least one first torque transfer member 340 structured and arranged to transfer at least one torque force from power-driven roller 310 to field-producing roller 314, as shown. Preferably, second rotator assembly 334 comprises at least one second torque transfer member 342 structured and arranged to transfer at least one torque force from a second power-driven roller 310 to press-down roller 320, as shown.

Preferably, air gap 330 is sized to provide substantially contemporaneous frictional contact between flexible magnetizable material 304, field-producing roller 314, and press-down roller 320. Thus, rotation of either field-producing roller 314 or press-down roller 320 (or more preferably both) advances the at least one substantially planar sheet of substantially flexible magnetizable material through air gap 330. In the absence of press-down roller 320, the rotation of field-producing roller 314 alone preferably assists in maintaining continuous forward movement of flexible magnetizable material 304 as it passes over field-producing roller 314. In either preferred arrangement, flexible magnetizable material 304 is stripped from field-producing roller 314 by separator members 318, as shown. Upon reading the teachings of this specification, those of ordinary skill in the art will now understand that, under appropriate circumstances, considering such issues as cost, intended use, etc., other arrangements, such as providing self-powered rollers by means of a dedicated electrical motor and coordinating gearing, utilizing a second (upper) magnet bar in lieu of a press-down roller to provide a high-energy magnetizer, etc., may suffice.

Figure 36:
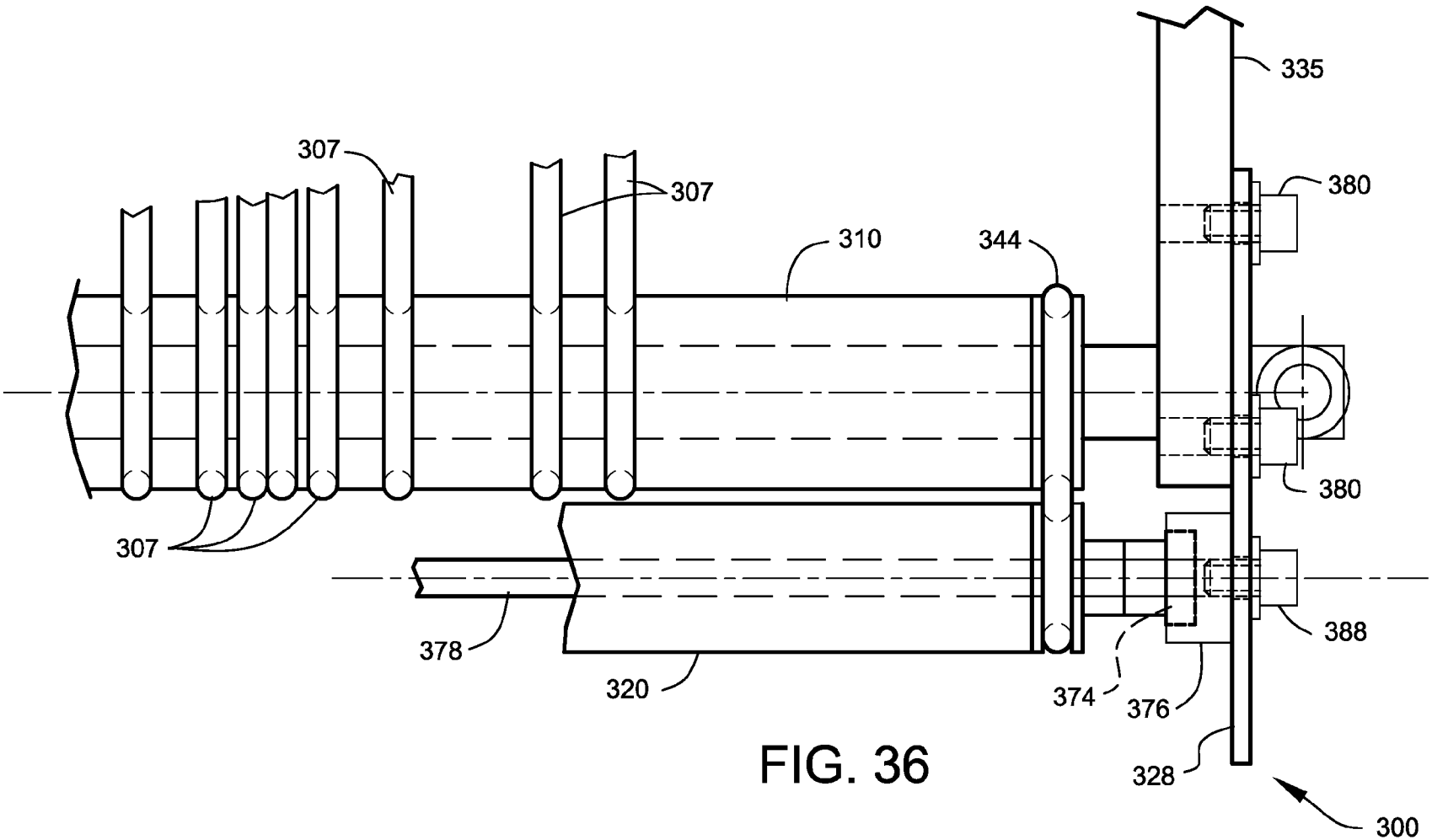
FIG. 36 shows a partial top view, of the sheet magnetizer modification mounted to the existing friction-type sheet feeder, according to the preferred embodiment of FIG. 26.

Preferably, both first torque transfer member 340 and second torque transfer member 342 comprise flexible drive belts 344 engaging power-driven rollers 310, as best illustrated in FIG. 36. Alternately preferably, first torque transfer member 340 and second torque transfer member 342 may comprise a chain drive assembly 346, as schematically illustrated in FIG. 34.

Figures 31, 32, 33, 34:
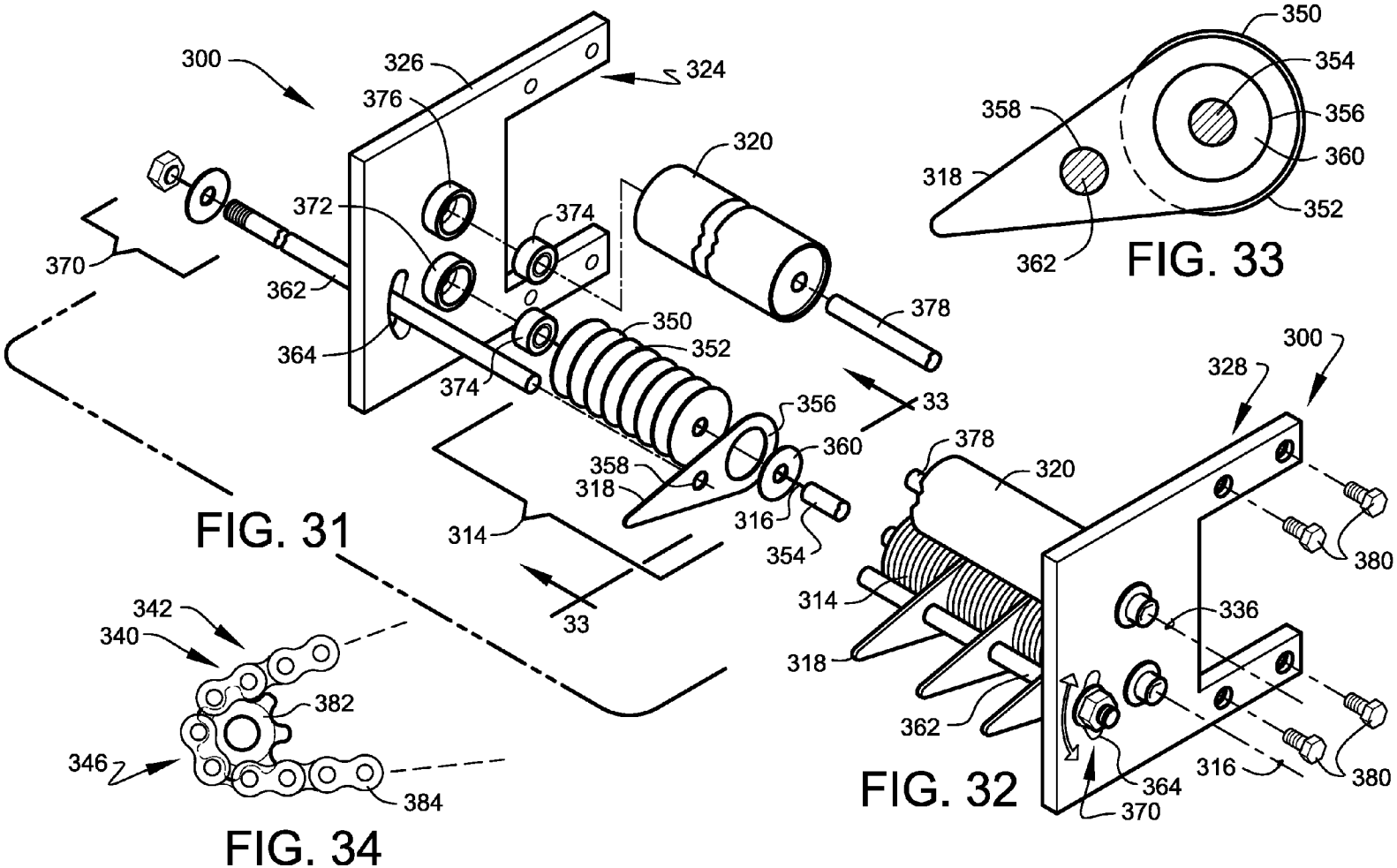
FIG. 31 shows a partial exploded view illustrating components of the sheet magnetizer modification of FIG. 26.
FIG. 32 shows a partial perspective view of an end plate assembly of the sheet magnetizer modification of FIG. 26.
FIG. 33 shows a sectional view through a magnetic roller of the sheet magnetizer modification of FIG. 26.
FIG. 34 shows a partial side view of an alternate chain drive assembly according to a preferred embodiment of the present invention.

FIG. 31 shows a partial exploded view illustrating preferred components of sheet magnetizer modification 300. FIG. 32 shows a partial perspective view of second endplate 328 of the assembled sheet magnetizer modification 300. FIG. 33 shows a sectional view through the section 33-33 of FIG. 31 illustrating preferred internal arrangements of field-producing roller 314. Reference is now made to FIG. 31 through FIG. 33 with continued reference to the prior figures.

Preferably, field-producing roller 314 comprises a plurality of substantially circular magnetic disks 350 each one magnetically coupled with at least one substantially circular flux-conducting spacer 352, as shown. Preferably, each magnetic disk 350 comprises a high-strength permanent magnet and each flux-conducting spacer 352 preferably comprises a magnetically conductive material, preferably a ferrous metal. A preferred size configuration for magnetic disks 350 and flux-conducting spacers 352 is a disk having an outer diameter of about one inch and a thickness of about 1/32 inch. Upon reading the teachings of this specification, those of ordinary skill in the art will now understand that, under appropriate circumstances, considering such issues as differing pole spacing, alternate roller size, etc., other size arrangements, such as thicker plate sizes, larger plate diameters, etc., may suffice.

Preferably, each magnetic disk 350 and flux-conducting spacer 352 is held in substantially coaxial alignment along first longitudinal axis 316 by central bar 354, as shown. A preferred physical configuration for central bar 354 comprises a 1/4 inch diameter cylindrical rod. Preferably, central bar 354 engages a complementary central aperture of magnetic disks 350 and flux-conducting spacers 352, as shown. It is noted that the quantities of magnetic disks 350 and flux-conducting spacers 352 are depicted schematically in FIG. 31, preferred numbers of disks and spacers may vary based on selected field strength requirements, selected length of roller, selected frequency of separator members 318, etc.

Preferably, separator members 318 are integrated within field-producing roller 314 at between about a 1/2" and 1" center-to-center spacing. Preferably, each separator member 318 comprises a generally cam-shaped plate having a large-diameter bore 356 and small-diameter bore 358, as shown. Preferably, the larger radius end of separator member 318 comprises an outer diameter slightly smaller than the magnetic disks 350 and flux-conducting spacers 352, preferably by about 1/16 inch, as shown. Preferably, each separator member 318 is constructed from a nonmagnetic material, most preferably metallic brass for durability. Preferably, large-diameter bore 356 engages a bearing washer 360 also preferably engaged on central bar 354, as shown. Preferably, bearing washer 360 comprises an outer journal diameter of about 5/8 inch. Preferably, large-diameter bore 356 is engineered to provide an appropriate internal clearance about bearing washer 360.

Preferably, the plurality of separator members 318 are maintained in relative alignment by alignment bar 362, as shown. Preferably, alignment bar 362 passes through slotted apertures 364 of first endplate 326 and second endplate 328 and the small-diameter bores 358 of each separator member 318, as shown. Preferably, the ends of alignment bar 362 are fitted with at least one end positioner, preferably a threaded fitting 370 adapted to maintain alignment bar 362 in a selected position within slotted apertures 364, preferably by frictional engagement with the outer face of a respective endplate. Thus, the angular position of the entire plurality of separator members 318 may be adjusted up and down to selected positions, as required.

Preferably, first endplate 326 and second endplate 328 comprise a first paired set of shaft receivers 372, each one structured and arranged to receive a respective end of central bar 354. Preferably, each shaft receiver 372 comprises at least one friction-reducing bearing 374 structured and arranged to assist reduced-friction rotation of central bar 354.

Preferably, press-down roller 320 is similarly attached to first endplate 326 and second endplate 328, preferably supported within a second paired set of shaft receivers 376, each one structured and arranged to rotatably receive a respective end of central bar 378 on which press-down roller 320 is preferably engaged. Preferably, each shaft receiver 376 also comprises at least one friction-reducing bearing 374 structured and arranged to assist reduced-friction rotation of central bar 378.

Preferably, first endplate 326 and second endplate 328 are rigidly mounted to existing friction-type sheet-handling device 302, preferably using mechanical fasteners 380, and most preferably a plurality of bolted connections, as shown. Upon reading the teachings of this specification, those of ordinary skill in the art will now understand that, under appropriate circumstances, considering such issues as user preference, intended use, etc., other mounting arrangements, such as quick release attachments, permanent mountings, bonding, thermal welding, etc., may suffice.

In alternate preferred embodiments of sheet magnetizer modification 300, first torque transfer member 340 and second torque transfer member 342 may preferably comprise chain drive assembly 346, as shown in FIG. 34. Such an arrangement may be preferable where high torque forces are developed at the rollers. Preferably, chain drive assembly 346 comprises chain sprocket 382 and a continuous drive chain 384, as shown. Preferably, chain sprocket 382 is engaged on the central bar of a roller, as shown. Preferably, drive chain 384 operationally engages chain sprocket 382 and a powered chain sprocket of existing friction-type sheet-handling device 302.

Figure 35:
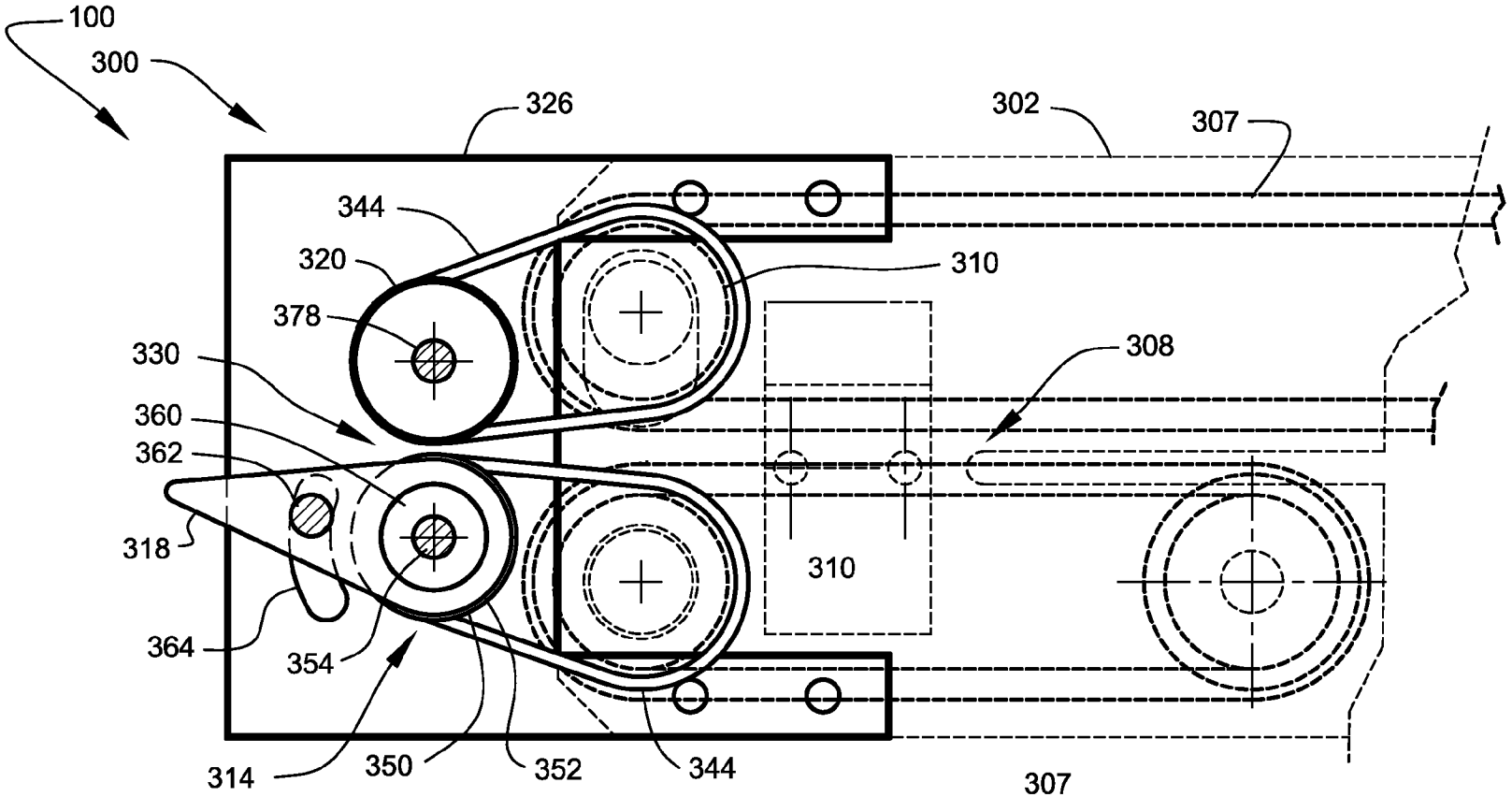
FIG. 35 shows a sectional view through the section 35-35 of FIG. 27.

FIG. 35 shows a sectional view through section 35-35 of FIG. 27 illustrating a preferred mounting of sheet magnetizer modification 300 to existing friction-type sheet-handling device 302 (shown by a dashed-line depiction). Preferably, field-producing roller 314 is situated substantially at the end of the sheet transport path 308, as shown. Less preferably, field-producing roller 314 may be located at alternate positions within sheet transport path 308, as shown in FIG. 37.

FIG. 36 shows a partial top view, of sheet magnetizer modification 300 mounted to existing friction-type sheet-handling device 302 (again shown by a dashed-line depiction). Flexible drive belt 344 is shown engaging both power-driven roller 310 and press-down roller 320. It is noted that the preferred arrangement for field-producing roller 314 is substantially the same. Preferably, flexible drive belt 344 is designed to engage power-driven roller 310 and a manner substantially similar to that of endless belts 307, as shown.

Preferably, each shaft receiver 372 is rigidly mounted to a respective endplate, preferably utilizing at least one mechanical fastener 388, as shown. Upon reading the teachings of this specification, those of ordinary skill in the art will now understand that, under appropriate circumstances, considering such issues as sheet thickness, cost, etc., other mounting arrangements, such as providing vertical shaft receiver/roller adjustability, etc., may suffice.

Figure 37:
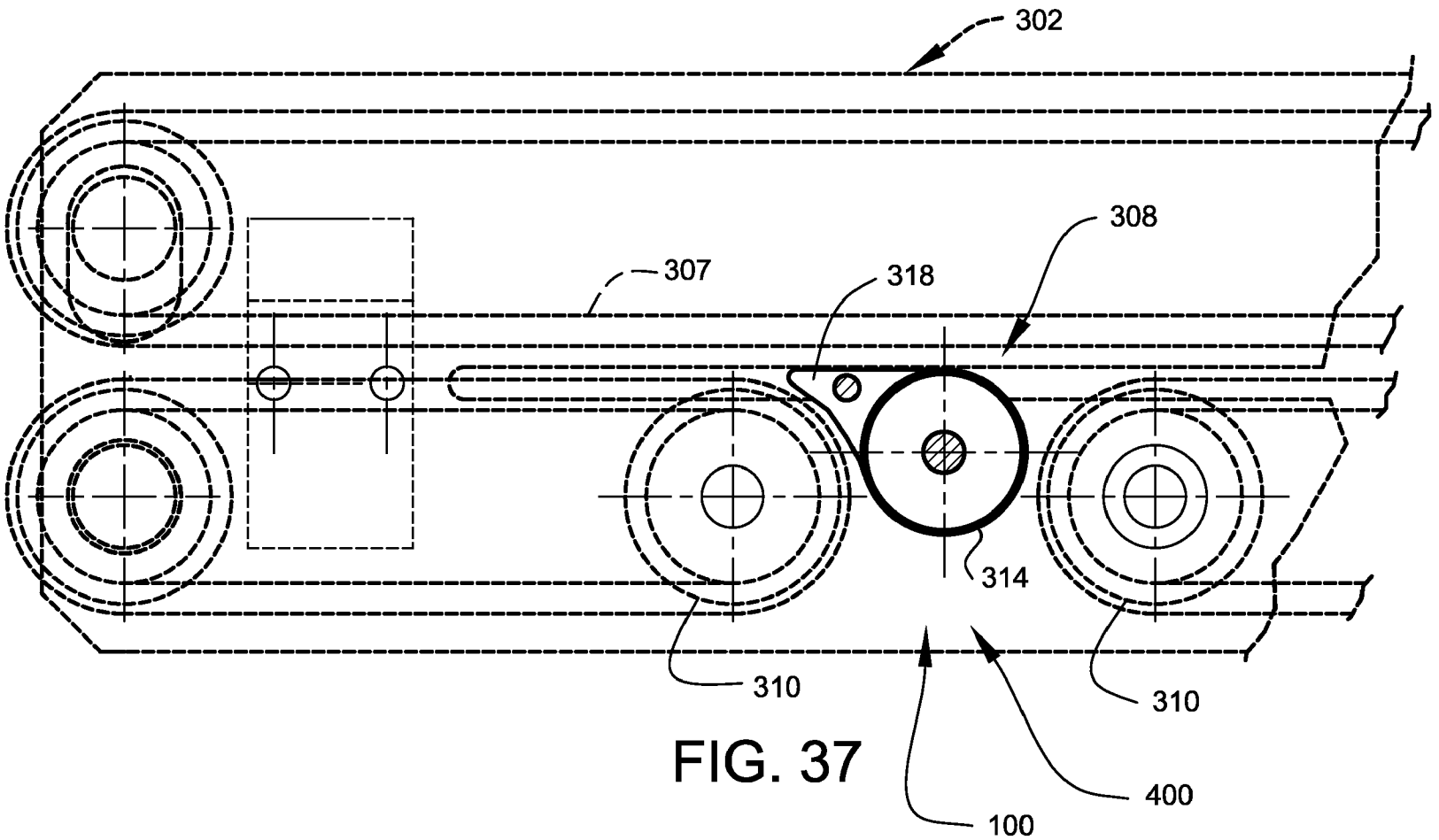
FIG. 37 shows a schematic sectional diagram, illustrating an alternate sheet magnetizer modification, according to another preferred embodiment of the present invention.

FIG. 37 shows a schematic sectional diagram, illustrating alternate sheet magnetizer modification 400, according to another preferred embodiment of the present invention. Preferably, alternate sheet magnetizer modification 400 comprises the mounting of field-producing roller 314 between two power-driven rollers 310, as shown.

Figure 38:
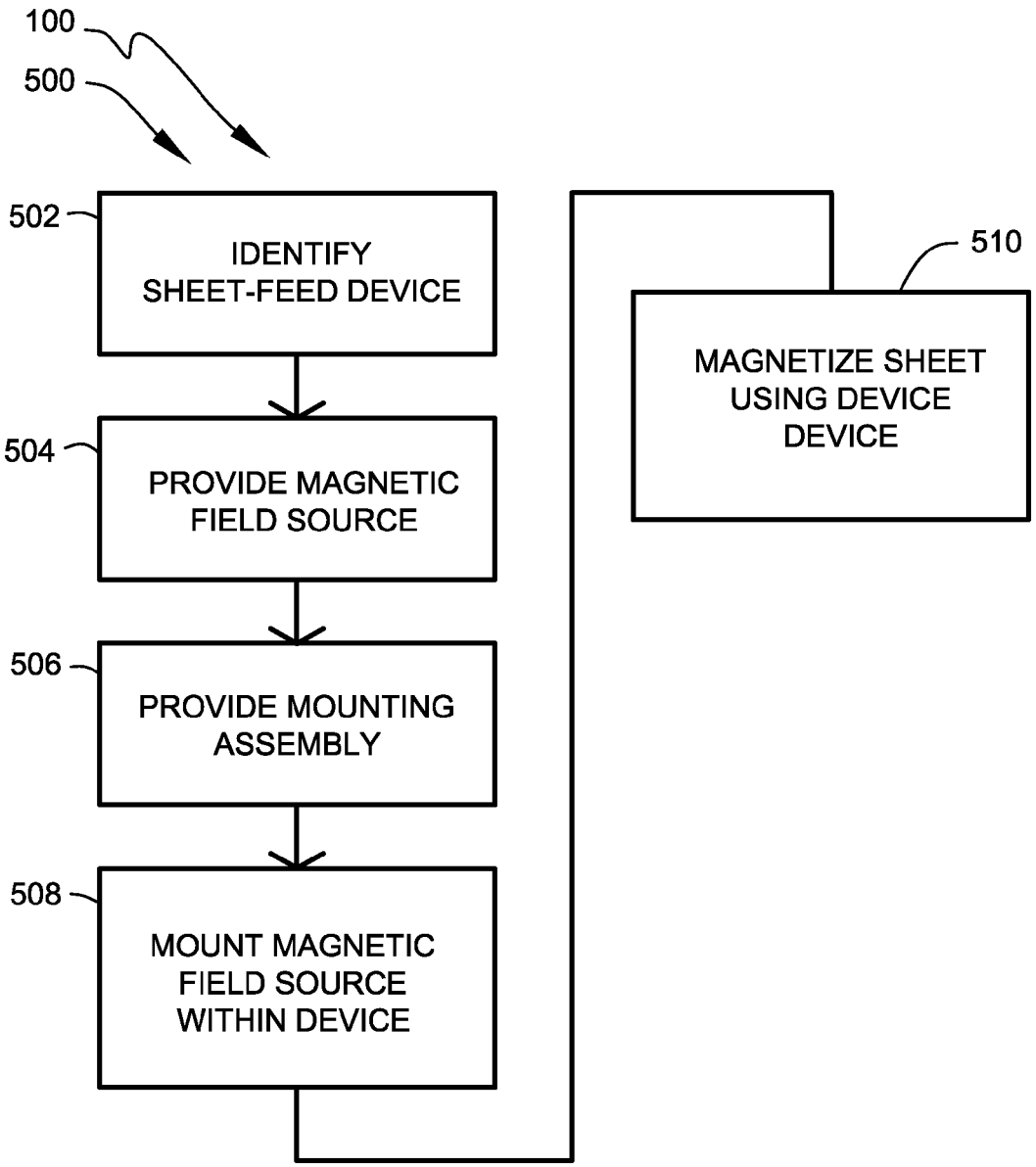
FIG. 38 shows a functional block diagram, illustrating a preferred method related to the deployments of the sheet magnetizer modification of FIG. 26 and the alternate sheet magnetizer modification of FIG. 37, according to a preferred method of the present invention.

FIG. 38 shows a functional block diagram, illustrating preferred method 500 related to the retrofitting of sheet magnetizer modification 300 to existing friction-type sheet-handling device 302 to enable magnetization of flexible magnetizable material 304, during movement of the sheet along sheet transport path 308. Method 500 preferably comprises the following steps.

First, at least one existing friction-type sheet-handling device 302 is identified, as indicated in preferred step 502. Preferably, such existing friction-type sheet-handling device 302 is substantially similar to the above-described designs enabling the movement of flexible magnetizable material 304 along sheet transport path 308, between at least one initial position and at least one final position. Next, at least one magnetic field source 312 usable to magnetize flexible magnetizable material 304 is provided in preferred step 504.

Next, at least one mounting assembly 324 is provided to assist the mounting of magnetic field source 312 to existing friction-type sheet-handling device 302, wherein such mounting assembly 324 is structured and arranged to situate magnetic field source 312 in at least one position producing at least one magnetic-field interaction between flexible magnetizable material 304 and the magnetic field as flexible magnetizable material 304 moves along sheet transport path 308, as indicated in preferred step 506.

In addition, method 500 further comprises the preferred step 508 of mounting magnetic field source 312 to existing friction-type sheet-handling device 302 using mounting assembly 324. Step 508 preferably produces the modified friction-type sheet-handling device 550 of FIG. 27 capable of permanently magnetizing flexible magnetizable material 304. Furthermore, method 500 comprises the preferred step 510 of permanently magnetizing flexible magnetizable material 304 using modified friction-type sheet-handling device 550 of FIG. 27.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system related to magnetization of at least one substantially planar sheet of substantially flexible magnetizable material having at least one pre-printed face surface, and at least one opposite face surface, said system comprising:

a) at least one first magnetic field source structured and arranged to produce at least one first magnetic field;

b) at least one second magnetic field source structured and arranged to produce at least one second magnetic field; and c) at least one geometric positioner structured and arranged to geometrically position said at least one first magnetic field source and said at least one second magnetic field source to generate at least one first high-flux field region resulting from at least one magnetic-field interaction between said at least one first magnetic field and said at least one second magnetic field;

d) wherein said at least one first high-flux field region is situate substantially between said at least one first magnetic field source and said at least one second magnetic field source;

e) wherein said at least one geometric positioner comprises at least one passage structured and arranged to allow moving passage of the substantially flexible magnetizable material through said at least one first high-flux field region;

f) wherein said at least one second magnetic field source is structured and arranged to physically contact at least one opposite face surface during passage of the at least one substantially planar sheet of substantially flexible magnetizable material through said at least one first high-flux field region; and g) wherein said at least one first magnetic field source is structured and arranged to avoid physical contact with the at least one pre-printed face surface during passage of the at least one substantially planar sheet of substantially flexible magnetizable material through said at least one first high-flux field region.

2. The system according to claim 1 wherein:

a) said at least one second magnetic field source comprises at least one advancer structured and arranged to movably advance the at least one substantially planar sheet of substantially flexible magnetizable material in at least one sheet-feed direction passing substantially through said at least one first high-flux field region; and b) such moving advancement of the said at least one second magnetic field source substantially through said at least one first high-flux field region results in substantially permanent magnetization of at least one first region of the substantially flexible magnetizable material.

3. The system according to claim 1 wherein said at least one geometric positioner comprises:

a) at least one upper support frame structured and arranged to support said at least one first magnetic field source; and b) at least one lower support frame structured and arranged to rotationally support said at least one second magnetic field source.

4. The system according to claim 3 wherein said at least one first magnetic field source and said at least one second magnetic field source are each generated by at least one permanent magnet.

5. The system according to claim 4 wherein:

a) said at least one first magnetic field source comprises at least one first magnetizer bar comprising at least one first longitudinal axis;

b) said at least one first magnetizer bar comprises a first set of discrete field-producing laminations spaced substantially along said at least one first longitudinal axis;

c) each discrete field-producing lamination of said first set comprises at least one substantially circular magnetic disk magnetically coupled with at least one substantially circular flux-conducting spacer; and d) each said at least one substantially circular magnetic disk and each said at least one substantially circular flux-conducting spacer are substantially coaxial with said at least one first longitudinal axis.

6. The system according to claim 5 wherein:

a) said at least one second magnetic field source comprises at least one second magnetizer bar comprising at least one second longitudinal axis;

b) said at least one second magnetizer bar comprises a second set of discrete field-producing laminations spaced substantially along said at least one second longitudinal axis;

c) each discrete field-producing lamination of said second set comprises at least one substantially circular magnetic disk magnetically coupled with at least one substantially circular flux-conducting spacer; and d) each said at least one substantially circular magnetic disk and each said at least one substantially circular flux-conducting spacer are substantially coaxial with said at least one second longitudinal axis.

7. The system according to claim 6 further comprising:

a) at least one powered rotator structured and arranged to rotate said at least one second magnetizer bar about said at least one second longitudinal axis;

b) wherein rotation of said at least one second magnetizer bar by said at least one powered rotator movably advances the at least one substantially planar sheet of substantially flexible magnetizable material through said at least one first high-flux field region by frictional contact with the at least one opposite face surface; and c) wherein the at least one substantially planar sheet of substantially flexible magnetizable material may be permanently magnetized by such movement through said at least one first high-flux field region.

8. The system according to claim 7 wherein said at least one upper support frame and said at least one lower support frame are structured and arranged to maintain said at least one first longitudinal axis and said at least one second longitudinal axis in substantially parallel alignment.

9. The system according to claim 8 wherein said at least one upper support frame and said at least one lower support frame are structured and arranged to maintain said at least one first longitudinal axis and said at least one second longitudinal axis in substantially vertical alignment.

10. The system according to claim 9 wherein:

a) said at least one upper support frame comprises at least one mount structured and arranged to removably mount said at least one upper support frame to said at least one lower support frame;

b) said at least one mount is structured and arranged to maintain said at least one upper support in a fixed position relative to said at least one lower support frame; and c) said at least one upper support frame is structured and arranged to provide at least one freedom of movement of said at least one first magnetizer bar relative to said at least one second longitudinal axis.

11. The system according to claim 10 further comprising:

a) at least one third magnetic field source structured and arranged to produce at least one third magnetic field; and b) at least one fourth magnetic field source structured and arranged to produce at least one fourth magnetic field;

c) wherein said at least one upper support frame is structured and arranged to support said at least one third magnetic field source;

d) wherein said at least one lower support frame structured and arranged to rotationally support said at least one fourth magnetic field source;

e) wherein said at least one upper support frame and said at least one lower support frame are structured and arranged to geometrically position said at least one third magnetic field source and said at least one fourth magnetic field source to generate at least one second high-flux field region resulting from at least one magnetic-field interaction between said at least one third magnetic field and said at least one fourth magnetic field;

f) wherein said at least one second high-flux field region is situate substantially between said at least one third magnetic field source and said at least one forth magnetic field source;

g) wherein said at least one passage is structured and arranged to allow moving passage of the substantially flexible magnetizable material through said at least one second high-flux field region;

h) wherein said at least one fourth magnetic field source is structured and arranged to come into physical contact with the at least one opposite face surface during passage of the at least one substantially planar sheet of substantially flexible magnetizable material through said at least one second high-flux field region; and i) wherein said at least one third magnetic field source is structured and arranged to avoid physical contact with the at least one pre-printed face surface during passage of the at least one substantially planar sheet of substantially flexible magnetizable material through said at least one second high-flux field region.

12. The system according to claim 11 wherein said at least one third magnetic field source and said at least one fourth magnetic field source are each generated by at least one permanent magnet.

13. The system according to claim 12 wherein:

a) said at least one third magnetic field source comprises at least one third magnetizer bar comprising at least one third longitudinal axis;

b) said at least one third magnetizer bar comprises a third set of discrete field-producing laminations spaced substantially along said at least one third longitudinal axis;

c) each discrete field-producing lamination of said third set comprises at least one substantially circular magnetic disk magnetically coupled with at least one substantially circular flux-conducting spacer; and d) each said at least one substantially circular magnetic disk and each said at least one substantially circular flux-conducting spacer is substantially coaxial with said at least one third longitudinal axis.

14. The system according to claim 13 wherein:

a) said at least one fourth magnetic field source comprises at least one fourth magnetizer bar comprising at least one fourth longitudinal axis;

b) said at least one fourth magnetizer bar comprises a fourth set of discrete field-producing laminations spaced substantially along said at least one fourth longitudinal axis;

c) each discrete field-producing lamination of said fourth set comprises at least one substantially circular magnetic disk magnetically coupled with at least one substantially circular flux-conducting spacer; and d) each said at least one substantially circular magnetic disk and each said at least one substantially circular flux-conducting spacer is substantially coaxial with said at least one forth longitudinal axis.

15. The system according to claim 14 wherein:

a) said at least one powered rotator is structured and arranged to provide powered rotation of said at least one fourth magnetizer bar about said at least one fourth longitudinal axis;

b) such powered rotation of said at least one fourth magnetizer bar movably advances the at least one substantially planar sheet of substantially flexible magnetizable material through said at least one second high-flux field region by frictional contact with the at least one opposite face surface; and c) at least one second region of the at least one substantially planar sheet of substantially flexible magnetizable material is permanently magnetized by such movement through said at least one second high-flux field region.

16. The system according to claim 15 wherein:

a) said at least one upper support frame and said at least one lower support frame are structured and arranged to maintain said at least one first longitudinal axis, said at least one second longitudinal axis, said at least one third longitudinal axis, and said at least one fourth longitudinal axis in substantially parallel alignment; and b) said at least one upper support frame and said at least one lower support frame are structured and arranged to maintain said at least one third longitudinal axis and said at least one fourth longitudinal axis in substantially vertical alignment.

17. The system according to claim 16 wherein:

a) said first set of discrete field-producing laminations of said at least one first magnetizer bar are axially offset from said third set of discrete field-producing laminations of said at least one third magnetizer bar; and b) said second set of discrete field-producing laminations of said at least one second magnetizer bar are axially offset from said fourth set of discrete field-producing laminations of said at least one fourth magnetizer bar.

18. The system according to claim 16 wherein:

a) said first set of discrete field-producing laminations of said at least one first magnetizer bar are vertically aligned with said second set of discrete field-producing laminations of said at least one second magnetizer bar; and b) said first set of discrete field-producing laminations and said second set of discrete field-producing laminations comprise opposite opposing polar moments.

19. The system according to claim 16 wherein said third set of discrete field-producing laminations of said at least one third magnetizer bar are vertically aligned with said fourth set of discrete field-producing laminations of said at least one fourth magnetizer bar.

20. The system according to claim 16 further comprising at least one rotation-rate coordinator structured and arranged to coordinate the rotation rates of said at least one second magnetizer bar and said at least one fourth magnetizer bar.

21. The system according to claim 16 wherein said at least one rotation-rate coordinator comprises at least one arrangement of intermeshed toothed gears.

22. The system according to claim 21 wherein said at least one powered rotator comprises:

a) at least one electrically driven motor comprising at least one output shaft structured and arranged to transmit at least one torque force produced by said at least one electrically driven motor;

b) coupled to said at least one output shaft, at least one first resilient roller rotationally supported within said at least one lower support frame;

c) at least one second resilient roller rotationally supported within said at least one lower support frame; and d) at least one third resilient roller rotationally supported within said at least one lower support frame;

e) wherein said at least one first resilient roller, said at least one second resilient roller, and said at least one third resilient roller are rotationally coupled by said at least one arrangement of intermeshed toothed gears;

f) wherein said at least one first resilient roller and said at least one second resilient roller are structured and arranged rotate said at least one second magnetizer bar by frictional contact;

g) wherein said at least one second resilient roller and said at least one third resilient roller are structured and arranged to rotate said at least one fourth magnetizer bar by frictional contact; and h) wherein rotation of said at least one first resilient roller induces rotation in said at least one second resilient roller, said at least one third resilient roller, said at least one second magnetizer bar, and said at least one fourth magnetizer bar.

23. A method related to magnetization of at least one sheet of substantially flexible magnetizable material having at least one first planar face and at least one second planar face, said method comprising the steps of:

a) providing at least one first magnet structured and arranged to produce at least one first magnetic field;

b) providing at least one second magnet structured and arranged to produce at least one second magnetic field;

c) producing at least one high-flux field region by geometrically positioning such at least one first magnet above such at least one second magnet to produce at least one high-flux gap therebetween;

d) forming at least one frictional surface contact between such at least one second magnet and the at least one second planar face;

e) manipulating such at least one second magnet to movably advance the at least one sheet of substantially flexible magnetizable material through such at least one high-flux gap; and f) at least partially magnetizing the at least one sheet of substantially flexible magnetizable material during such advancement through such at least one high-flux gap.

24. The method according to claim 23 wherein the step of manipulating such at least one second magnet to movably advance the at least one sheet of substantially flexible magnetizable material through such at least one high-flux gap comprises the step of rotating such at least one second magnet to facilitate such advancement.

25. A method related to hand-held magnetization of at least one sheet of substantially flexible magnetizable material comprising at least one substantially planar surface, said method comprising the steps of:

a) providing at least one modular end cap structured and arranged to rotationally engage at least one first end of at least one cylindrical magnet bar;

b) selecting from a set of hand-holdable bodies comprising differing fixed lengths, at least one fixed-length hand-holdable body structured and arranged to rotationally engage at least one second end of the at least one cylindrical magnet bar;

c) selecting from a set of cylindrical magnet bars comprising differing fixed lengths, at least one cylindrical magnet bar comprising a fixed length compatible with such at least one fixed-length hand-holdable body;

d) engaging such at least one second end of such at least one cylindrical magnet bar within such at least one fixed-length hand-holdable body;

e) engaging such at least one first end of such at least one cylindrical magnet bar within such modular end cap; and f) mounting such modular end cap to such at least one fixed-length hand-holdable body.

26. The method according to claim 25 further comprising the steps of:

a) hand gripping such at least one fixed-length hand-holdable body;

b) positioning such at least one cylindrical magnet bar to contact the at least one substantially planar surface; and c) rolling such at least one cylindrical magnet bar across the at least one substantially planar surface wherein at least partial magnetization of the at least one substantially planar sheet of substantially flexible magnetizable material is achieved.

27. A system related to the retrofitting of at least one friction-type sheet-handling device to enable magnetization of at least one substantially planar sheet of substantially flexible magnetizable material, during movement of such at least one substantially planar sheet of substantially flexible magnetizable material along at least one transport path of the at least one friction-type sheet-handling device, said system comprising:

a) at least one magnetic field source structured and arranged to generated at least one magnetic field usable to magnetize the at least one substantially planar sheet of substantially flexible magnetizable material; and b) at least one mount structured and arranged to mount said at least one magnetic field source to the at least one friction-type sheet-handling device;

c) wherein said at least one mount comprises at least one positioner structured and arranged to situate said at least one magnetic field source in at least one position producing at least one magnetic-field interaction between such at least one substantially planar sheet of substantially flexible magnetizable material and the magnetic field as such at least one substantially planar sheet of substantially flexible magnetizable material moves along the at least one transport path; and d) wherein such at least one substantially planar sheet of substantially flexible magnetizable material may be permanently magnetized by such at least one magnetic-field interaction.

28. The system according to claim 27 wherein said at least one magnetic field source comprises a) at least one field-producing roller structured and arranged to produce the magnetic field;

b) wherein said at least one field-producing roller is rotatably held by said at least one mount.

29. The system according to claim 28 wherein said at least one magnetic field source further comprises:

a) at least one field-conducting roller structured and arranged to form at least one magnetic circuit with said at least one magnetic roller; and b) situate between said at least one field-producing roller and said at least one field-conducting roller, at least one air gap structured and arranged to enable passage of such at least one substantially planar sheet of substantially flexible magnetizable material, therethrough;

c) wherein said at least one field-conducting roller is rotatably held by said at least one mount.

30. The system according to claim 29 wherein:

a) said at least one field-producing roller comprises at least one first rotator structured and arranged to rotate said at least one field-producing roller, in at least one first direction, about at least one first rotational axis oriented substantially perpendicular to the movement of such at least one substantially planar sheet of substantially flexible magnetizable material, during passage of such at least one substantially planar sheet of substantially flexible magnetizable material through said at least one air gap;

b) said at least one field-conducting roller comprises at least one second rotator structured and arranged to rotate said at least one field-producing roller, in at least one second direction, about at least one second rotational axis oriented substantially perpendicular to the movement of such at least one substantially planar sheet of substantially flexible magnetizable material, during passage of such at least one substantially planar sheet of substantially flexible magnetizable material through said at least one air gap;

c) said at least one air gap is sized to provide substantially contemporaneous frictional contact between such at least one substantially planar sheet of substantially flexible magnetizable material and both said at least one field-producing roller and said at least one field-conducting roller during passage therethrough; and d) such rotation of said at least one field-producing roller and said at least one field-conducting roller movably advance the at least one substantially planar sheet of substantially flexible magnetizable material through said at least one air gap.

31. The system according to claim 30 wherein said at least one first rotator comprises at least one first torque transfer member structured and arranged to transfer at least one first torque force of at least one first rotating member of the at least one friction-type sheet-handling device to said at least one field-producing roller.

32. The system according to claim 30 wherein said at least one second rotator comprises at least one second torque transfer member structured and arranged to transfer at least one second torque force of at least one second rotating member of the at least one friction-type sheet-handling device to said at least one field-conducting roller.

33. The system according to claim 31 wherein said at least one first torque transfer member comprises at least one substantially flexible drive belt.

34. The system according to claim 31 wherein said at least one first torque transfer member comprises at least one chain drive structured and arranged to engage at least one sprocket gear.

35. The system according to claim 32 wherein said at least one second torque transfer member comprises at least one substantially flexible drive belt.

36. The system according to claim 32 wherein said at least one second torque transfer member comprises at least one chain drive structured and arranged to engage at least one sprocket gear.

37. The system according to claim 29 wherein such at least one magnetic field source is generated by at least one permanent magnet.

38. The system according to claim 37 wherein:

a) said at least one field-producing roller comprises a plurality of substantially circular magnetic disks each one magnetically coupled with at least one substantially circular flux-conducting spacer; and b) each said at least one substantially circular magnetic disk and each said at least one substantially circular flux-conducting spacer are substantially coaxial with said at least one first longitudinal axis.

39. The system according to claim 38 further comprising at least one separator member structured and arranged to separate such at least one substantially planar sheet of substantially flexible magnetizable material from said at least one field-producing roller after such permanent magnetization.

40. The system according to claim 39 wherein said at least one mount comprises:

a) at least one first end plate and at least one second end plate;

b) wherein said at least one first end plate and said at least one second end plate comprise i) at least one paired set of receivers, each one structured and arranged to rotatably receive a respective end of said at least one field-producing roller and said at least one field-conducting roller, and ii) at least one mechanical fastener structured and arranged to mechanically fasten said at least one first end plate and said at least one second end plate to the at least one friction-type sheet-handling device;

c) wherein each paired set of receiver comprises at least one friction-reducing bearing structured and arranged to assist reduced-friction rotation of said at least one field-producing roller and said at least one field-conducting roller.

41. The system according to claim 39 wherein said at least one field-conducting roller is situate substantially at the end of the at least one transport path of the at least one friction-type sheet-handling device.

42. A method related to the retrofitting of at least one friction-type sheet-handling device to enable magnetization of at least one substantially planar sheet of substantially flexible magnetizable material, during movement of such at least one substantially planar sheet of substantially flexible magnetizable material along at least one transport path of the at least one friction-type sheet-handling device, said method comprising the steps of:

a) identifying at least one friction-type sheet-handling device adapted to move such at least one substantially planar sheet of substantially flexible magnetizable material along at least one transport path between at least one initial position and at least one final position;

b) providing at least one magnetic field source structured and arranged to generated at least one magnetic field usable to magnetize the at least one substantially planar sheet of substantially flexible magnetizable material; and c) providing at least one mount to assist the mounting of such at least one magnetic field source to the at least one friction-type sheet-handling device, wherein such at least one mount is structured and arranged to situate such at least one magnetic field source in at least one position producing at least one magnetic-field interaction between such at least one substantially planar sheet of substantially flexible magnetizable material and the magnetic field as such at least one substantially planar sheet of substantially flexible magnetizable material moves along the at least one transport path.

43. The method according to claim 41 further comprising the step of:

a) mounting such at least one magnetic field source to the at least one friction-type sheet-handling device using such at least one mount;

b) wherein at least one modified friction-type sheet-handling device capable of permanently magnetizing such at least one substantially planar sheet of substantially flexible magnetizable material is achieved.

44. The method according to claim 42 further comprising the step of permanently magnetizing such at least one substantially planar sheet of substantially flexible magnetizable material using such at least one modified friction-type sheet-handling device.

* * * * *